US005279920A

United States Patent [19]

Onodera et al.

[11] Patent Number: 5,279,920

[45] Date of Patent: Jan. 18, 1994

[54] SILVER HALIDE PHOTOGRAPHIC LIGHT SENSITIVE MATERIAL

[75] Inventors: Akira Onodera; Yasushi Usagawa, both of Hino, Japan

[73] Assignee: Konica Corporation, Tokyo, Japan

[21] Appl. No.: 966,436

[22] Filed: Oct. 26, 1992

[30] Foreign Application Priority Data

Nov. 1, 1991 [JP] Japan ..... 3-287997

[51] Int. Cl.[5] ..... G03C 1/06

[52] U.S. Cl. ..... 430/264; 430/598

[58] Field of Search ..... 430/264, 598

[56] References Cited

U.S. PATENT DOCUMENTS

| | | | |
|---|---|---|---|
| 2,497,875 | 2/1950 | Fallesen | 430/409 |
| 2,588,982 | 3/1952 | Ives | 430/409 |
| 2,592,250 | 4/1952 | Davey et al. | 430/569 |
| 3,271,157 | 9/1966 | McBride | 430/599 |
| 3,317,322 | 5/1967 | Porter et al. | 430/567 |
| 3,367,778 | 2/1968 | Berriman | 430/598 |
| 3,447,927 | 6/1969 | Bacon et al. | 430/616 |
| 3,531,291 | 9/1970 | Bacon | 430/599 |
| 3,761,266 | 9/1973 | Milton | 430/598 |
| 4,686,167 | 8/1987 | Resnick et al. | 430/264 |
| 4,971,888 | 11/1990 | Okada et al. | 430/264 |
| 4,988,604 | 1/1991 | Machonkin et al. | 430/264 X |
| 4,994,365 | 2/1991 | Looker et al. | 430/598 |
| 5,041,355 | 8/1991 | Machonkin et al. | 430/264 |

FOREIGN PATENT DOCUMENTS

| | | |
|---|---|---|
| 0382445A1 | 8/1990 | European Pat. Off. . |
| 0449563A1 | 10/1991 | European Pat. Off. . |

*Primary Examiner*—Charles L. Bowers, Jr.
*Assistant Examiner*—Thomas R. Neville
*Attorney, Agent, or Firm*—Finnegan, Henderson, Farabow, Garrett & Dunner

[57] ABSTRACT

There is disclosed a silver halide photographic light-sensitive material containing a compound represented by the following formula. The photographic material provides sufficiently high contrast images using a stable developer having a low pH value. The photographic material also provides a direct-positive type photographic material improved in image quality and storage stability.

8 Claims, No Drawings

SILVER HALIDE PHOTOGRAPHIC LIGHT SENSITIVE MATERIAL

FIELD OF THE INVENTION

This invention relates to a silver halide photographic light sensitive material, particularly to a novel silver halide photographic light sensitive material provided with an extra-high contrast photographic characteristic, which is applicable to a photomechanical process, and to a direct-positive type silver halide photographic light sensitive material capable of displaying an excellent image quality.

BACKGROUND OF THE INVENTION

In a photomechanical process where a continuous tones densities of an original are converted respectively into the group consisting of the halftone dots having the areas proportional to the density, a silver halide photographic light sensitive material having a high contrast photographic characteristic is generally used.

For providing a high contrast characteristic to an image, a prefered photographic light sensitive material has been prepared in such a manner as described in Japanese Patent Publication Open to Public Inspection (hereinafter referred to as JP OPI Publication) No. 56-106244/1981 and U.S. Pat. No. 4,686,167; in which a compound such as hydrazine is contained as the so-called nucleating agent in a silver halide photographic light sensitive material and silver halide grains capable of effectively displaying the contrast-increasing characteristic of the compound are further used or other photographic additives are suitably used in combination. The silver halide photographic light sensitive materials such as those mentioned above are apparently proved to be stable as a light sensitive material and a high contrast photographic image can be obtained even when they are processed with a rapid processable developer.

However, the system applied with such a hydrazine compound as mentioned above has the disadvantage that a light sensitive material is to be developed generally at a high pH value, and a development has conventionally been made at a pH value of not lower than 11.5. Such a high alkaline developer as mentioned above is not suitable for a prolonged term preservation, because it is liable to an air oxidation and a development characteristic variation. Is is also unprefered from the viewpoints of the corrosion of developing equipments, the safety problems of operations and the environmental problems of waste liquids.

In regard to the avoidance of the problems of the high alkaline developers, European Patent Nos. 253,665, 333,435, 345,025 and 356,898, U.S. Pat. Nos. 4,988,604, 4,994,365 and 5,041,355 and JP OPI Publication Nos. 63-223744/1988, 63-234244/1988, 63-234245/1988, 63-234426/1988 and 2-77057/1990 disclose the silver halide photographic light sensitive materials each capable of obtaining a high contrast photographic image when making use of a developer having a pH, for example, not higher than 11.2. However, the contrast-increasing activity of the contrast-increasing agent applicable to the above-mentioned light sensitive materials have had such a disadvantage that an excellent halftone dot quality and a desirable black dot level (that is, a sand-like or pinhole-like fog produced in an unexposed area) cannot stably be obtained, because the pH of the developer is seriously varied when the pH of not higher than 11.2 is varied and the gamma and speed are liable to be varied when the pH is varied by the processing exhaustion or air oxidation of the developer.

It has therefore been demanded for a silver halide photographic light sensitive material capable of obtaining a sufficiently high contrast even when making use of a low pH developer and providing the stable photographic characteristics even when the pH is varied.

On the other hand, as one of the methods for forming a positive image with the use of a direct positive type silver halide photographic light sensitive material, there has been known a method for forming a positive image in which an unfogged internal latent image type silver halide emulsion is used and a surface development is carried out, after an exposure to light, in the presence of a foggant.

In the above-mentioned technical field, various techniques have been known so far. For example, these techniques include, typically, those described in U.S. Pat. Nos. 2,592,250, 2,456,957, 2,497,875 and 2,588,982, British Patent No. 1,151,363, JP Examined Publication No. 43-29405/1968, JP OPI Publication Nos. 47-9434/1972, 47-9677/1972, 47-32813/1972, 47-32814/1972, 48-9727/1973 and 48-9717/1973, U.S. Pat. Nos. 3,761,266 and 3,496,577 and JP OPI Publication Nos. 50-8524/1975 and 50-38525/1975.

As for the useful foggants, hydrazine compounds have been known.

For example, foggants applicable thereto include hydrazine compounds given in U.S. Pat. Nos. 2,563,758 and 2,588,982, naphthyl hydrazine sulfonic acid given in U.S. Pat. No. 2,064,700, and sulfomethyl hydrazines given in British Patent No. 1,403,018. Further, JP Examined Publication No. 41-17184/1966 describes that a color positive image is obtained by making use of hydrazide or a hydrazone compound.

However, when making use of the above-given compounds, the induction period before starting a development is longer than in the development of an ordinary latent image forming silver. Therefore, the development turns out to be considerably delayed.

When the conventional techniques are applied to a multilayered color photographic light sensitive material, these techniques have had such a problem that the characteristics are liable to cause an ununiformity between the layers and the resultant maximum density becomes lower.

For obtaining an excellent result while keeping a desirable fogging function, a development has been carried out at a high pH of not lower than 12. However, this type of developments have not desirable at all, because the deterioration of a developing agent is seriously accelerated and the physical property of layers of a photographic light sensitive material is deteriorated.

As for the direct-positive type silver halide photographic light sensitive materials, it has been demanded to provide a light sensitive material containing an advantageous foggant improved in the above-mentioned problems.

SUMMARY OF THE INVENTION

It is an object of the invention to provide a silver halide photographic light sensitive material having a sufficiently high contrast with the use of a stable developer.

Another object of the invention is to provide a silver halide photographic light sensitive material capable of keeping the stable photographic characteristics even when making use of a low pH developer.

A further object of the invention is to provide a silver halide photographic light sensitive material capable of obtaining an excellent image having a sufficiently high maximum density (Dmax) when making use of a low pH developer, having a high maximum density and a low minimum density (Dmin) even when fogging developed for a shortened time and having few minimum density increase even after an aging storage, particularly when the invention is applied to a direct-positive type silver halide photographic light sensitive material.

The above-mentioned objects of the invention can be achieved with the silver halide photographic light sensitive materials having the following constitution.

Thus, the above-mentioned objects of the invention can be achieved with a silver halide photographic light sensitive material having at least one silver halide emulsion layer, wherein at least one of the compounds represented by the following Formula [I] is contained.

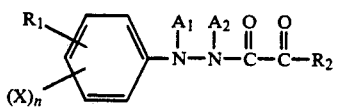

Formula [I]

wherein $R_1$ represents $R_3O$- in which $R_3$ represents a hydrogen atom, an aliphatic group, an aromatic group or a heterocyclic group, $R_4—SO_2NH—$ in which $R_4$ represents an aliphatic group, an aromatic group or a heterocyclic group, $(R_5)(R_6)(P{=}O)—NH—$ in which $R_5$ and $R_6$ represent each $-OR_0$, $—N(R_0)(R_{00})$ in which $R_0$ represents a aliphatic group, an aromatic group or a heterocyclic group and $R_{00}$ represents a hydrogen atom, an aliphatic group, an aromatic group or a heterocyclic group, an aliphatic group, an aromatic group or a heterocyclic group, $N{\equiv}C—NH—$, $HS—$, $HO—N{=}CH—$, $(R_7)(R_8)N—$ in which $R_7$ and $R_8$ represent each a hydrogen atom, an aliphatic group, an aromatic group or a heterocyclic group, $(R_9)(R_{10})C{=}N—$ in which $R_9$ represents a hydrogen atom, an aliphatic group, an aromatic group or a heterocyclic group and $R_{10}$ represents an aliphatic group, an aromatic group or a heterocyclic group, an active methylene group or an active methine group; X represents a substituent; n is an integer of 0 to 4, provided, when n is not less than 2, X may be the same as or different from each other; $A_1$ and $A_2$ represent each a hydrogen atom or one of them represents a hydrogen atom and the other one represents an acyl group, a sulfonyl group or an oxalyl group; and $R_2$ represents a group represented by the following formula [II] or [III].

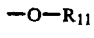

Formula [II]

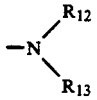

Formula [III]

wherein $R_{11}$ represents an alkenyl group, an alkynyl group, an aryl group or a heterocyclic group; $R_{12}$ represents a hydrogen atom, an aliphatic group, an aromatic group or a heterocyclic group; and $R_{13}$ represents an alkenyl group, an alkynyl group, an aryl group, a hydroxy group, an alkoxy group or a heterocyclic group.

However, among the compounds represented by the above-given Formula [I], at least one of $R_1$, X or $R_2$ represents a group having the component structure represented by the following Formula [IV].

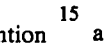

Formula [IV]

wherein Y represents an alkylene group, alkenylene group or arylene group, each of which may have a substituent and m is an integer of not less than 2.

DETAILED DESCRIPTION OF THE INVENTION

Now, the compounds represented by Formula [I] will be further detailed.

When $R_1$ represents an $R_3—O—$ group, $R_3$ represents a hydrogen atom, an aliphatic group including, for example, an alkyl group such as a methyl group, an ethyl group, a propyl group, a t-butyl group, a butyl group, a cyclohexyl group, an octyl group and a dodecyl group, an alkenyl group such as a vinyl group, an allyl group and a butenyl group and an alkynyl group such as a propargyl group and a butynyl group, an aromatic group including, for example, a phenyl group and a naphthyl group, or a heterocyclic group including, for example, a pyridyl group, a thienyl group, a furyl group, a pyrimidinyl group, a pyrrolyl group, a piperidinyl group, a tetrahydrofuryl group and a pyrrolidinyl group. When $R_3$ represents an aliphatic group, an aromatic group or a heterocyclic group, these groups may further be substituted by a suitable substituent including, for example, an alkyl group, an alkenyl group, an alkynyl group, an aryl group, a heterocyclic group, a heterocyclic onium group, an amino group, an ammonium group, an acylamino group, a carbamoyl group, a sulfonamido group, a sulfamoyl group, a ureido group, an alkoxy group, an aryloxy group, a heterocyclic-oxy group, a hydroxy group, a urethane group, an alkylthio group, an arylthio group, a heterocyclic-thio group, a sulfonyl group, a sulfinyl group, a halogen atom, a cyano group, a sulfo group, a carboxyl group, an acyloxy group, acyl group, an alkyloxycarboxyl group, an aryloxycarbonyl group, a nitro group, a thioacyl group, a thioacylamino group and a thioureido group. When $R_3$ represents an aromatic group or a heterocyclic group, these rings may be condensed with a suitable ring including, for example, a benzene ring, a cyclohexene ring, a cyclohexane ring, a cyclopentene ring, a cyclopentane ring, a pyridine ring, a thiophene ring, a fran ring, a triazole ring, an imidazole ring, a thiazole ring, a selenazole ring, an oxazole ring and a pyrrole ring so as to form a condensed ring.

When $R_1$ represents an $R_3—O—$ group, $R_3$ represents preferably a hydrogen atom, an aliphatic group or an aromatic group and more preferably a hydrogen atom or an aliphatic group.

When $R_1$ represents an $R_4—SO_2NH—$ group, $R_4$ represents an aliphatic group including, for example, an alkyl group such as a methyl group, an ethyl group, a propyl group, a butyl group, a hexyl group, an octyl group and a dodecyl group, an alkenyl group such as an allyl group and a butenyl group, and an alkynyl group such as a propargyl group and a butynyl group, an aromatic group including, for example, a phenyl group and a naphthyl group, or a heterocyclic group including, for example, a pyridyl group, a thienyl group, a furyl group, a pyridinyl group, a pyrrolyl group, a piperidinyl group, a tetrahydrofuryl group and a pyrrolidinyl group. These groups may also be substituted by a suitable substituent including, for example, the groups given as the examples of the suitable substituents which may be substituted to the aliphatic group, group or a heterocyclic group represented by $R_3$ in the above-given $R_3O$— group. When $R_4$ represents an aromatic group or a heterocyclic group, these rings may be condensed with a suitable ring so as to form a condensed ring. The suitable rings include, for example, the rings given as the examples of the suitable rings in the case where the aromatic or heterocyclic groups represented by $R_3$ in the foregoing $R_3O$— groups are condensed with a suitable rings so as to form the condensed rings.

When $R_1$ represents an $R_4$—$SO_2NH$— group, $R_4$ is desirable to represent an aliphatic or aromatic group.

When $R_1$ represents an $(R_5)(R_6)(P{=}O)$—NH—, $R_5$ and $R_6$ represent each —$OR_0$, —$N(R_0)(R_{00})$ provided, $R_0$ represents an aliphatic group such as a methyl group, a t-butyl group, an octyl group, a t-octyl group, a cyclohexyl group, a dodecyl group, an allyl group, a butenyl group and a hexenyl group, an aromatic group such as a phenyl group and a naphthyl group, or a heterocyclic group such as a pyridyl group, a thienyl group, a furyl group, a pyrimidinyl group, a pyrazolyl group, an imidazolyl group, a thiazolyl group, an oxazolyl group, a pyrrolyl group, a tetrahydrofuryl group and a pyrrolidinyl group; and $R_{00}$ represents a hydrogen atom or the aliphatic, aromatic or heterocyclic groups described of $R_0$, an aliphatic group including, for example, an alkyl group such as a methyl group, a t-butyl group, an octyl group, a t-octyl group, a cyclohexyl group and a dodecyl group, and an alkenyl group such as an allyl group, a butenyl group and a hexenyl group, an aromatic group including, for example, a phenyl group and a naphthyl group, or a heterocyclic group including, for example, a pyridyl group, a thienyl group, a furyl group, a pyrimidinyl group, a pyrazolyl group, an imidazolyl group, a thiazolyl group, an oxazolyl group, a pyrrolyl group, a tetrahydrofuryl group and a pyrrolidinyl group. The above-given groups may also be substituted with a suitable substituent including, for example, the groups given as the examples of the suitable substituents which may be substituted to the aliphatic, aromatic or heterocyclic groups represented by $R_3$ in the foregoing $R_3O$— groups. When $R_5$ or $R_6$ represents an aromatic or heterocyclic group, these rings each may be condensed with a suitable ring so as to form a condensed ring. The suitable rings may include, for example, the rings given as the examples of the suitable rings when the aromatic or heterocyclic groups represented by $R_3$ in the foregoing $R_3O$— groups are each condensed with a suitable ring so as to form a condensed ring.

When $R_1$ represents an $(R_7)(R_8)N$— group, $R_7$ and $R_8$ represent each a hydrogen atom, an aliphatic group including, for example, an alkyl group such as a methyl group, an ethyl group, a propyl group, a butyl group, a hexyl group, an octyl group and a dodecyl group, an alkenyl group such as an allyl group and a butenyl group, and an alkynyl group such as a propargyl group and a butynyl group, an aromatic group including, for example, a phenyl group and a naphthyl group, or a heterocyclic group including, for example, a pyridyl group, a thienyl group, a furyl group, a pyrimidinyl group, a pyrrolyl group, a piperidinyl group, a tetrahydrofuryl group and a pyrrolidinyl group. When $R_7$ or $R_8$ represents an aliphatic, aromatic or heterocyclic group, these groups may further be each substituted by a suitable substituent including, for example, the groups given as the examples of the suitable substituents which may further be substituted to the aliphatic, aromatic or heterocyclic group represented by $R_3$ in the foregoing $R_3O$— group. When $R_7$ or $R_8$ represents an aromatic or heterocyclic group, these rings may be condensed with a suitable ring so as to form a condensed ring. The suitable rings include, for example, the rings given as the examples of the suitable rings when the aromatic or heterocyclic group represented by $R_3$ in the foregoing $R_3O$— group is condensed with a suitable ring so as to form a condensed ring.

$R_7$ and $R_8$ may also form a ring together with a nitrogen atom, and they may further be so cyclized as to form a heterocyclic ring containing a hetero atom therein.

$R_7$ and $R_8$ are preferable to represent each a hydrogen atom, an aliphatic group or an aromatic group.

When $R_1$ represents an $(R_9)(R_{10})C{=}N$— group, $R_9$ represents a hydrogen atom, an aliphatic group including, for example, a methyl group, an ethyl group, a propyl group, an i-propyl group, a butyl group, a t-butyl group, a hexyl group, a cyclohexyl group, an octyl group, a dodecyl group and a vinyl group, an aromatic group including, for example, a phenyl group and a naphthyl group, or a heterocyclic group including, for example, a pyridyl group, a thienyl group, a furyl group and a tetrahydrofuryl group, and $R_{10}$ represents an aliphatic group, an aromatic group or a heterocyclic group. The desirable examples thereof include the same groups as those given for $R_9$. When $R_9$ represents an aliphatic, aromatic or heterocyclic group, these groups may further be substituted by a suitable substituent including, for example, the groups given as the examples of the suitable substituents which may also be substituted to the aliphatic, aromatic or heterocyclic groups represented by $R_3$ in the foregoing $R_3O$— groups. When $R_9$ or $R_{10}$ represents an aromatic or heterocyclic group, these rings may be condensed with a suitable ring so as to form a condensed ring. The suitable rings include, for example, those given as the suitable rings when the aromatic or heterocyclic groups represented by $R_3$ in the foregoing $R_3O$— groups are each condensed with a suitable ring so as to form a condensed ring.

$R_9$ and $R_{10}$ may form a ring together with a carbon atom and they may also be so cyclized as to form a hetero ring containing a hetero atom therein.

$R_9$ preferably represents a hydrogen atom, an aliphatic group or an aromatic group and preferably represents a hydrogen atom.

$R_{10}$ preferably represents an aliphatic group or an aromatic group.

In the case of $R_1$, the active methylene groups include, for example, —$CH_2COOR$, —$CH_2COR$, —$CH_2$-CONH—R, —$CH_2SO_2R$ in which R represents an aliphatic group, an aromatic group or a heterocyclic group and the desirable examples thereof include the same groups as those given in the case of $R_4$, —$CH_2CN$ and —$CH_2NO_2$.

In the case of $R_1$, the active methine groups include, for example, —CH(COOR')(COOR''), —CH(COR')-(COOR''), —CH(COR')(CONHR''), —CH($NO_2$)-(COOR'), —CH(CN)(COOR') and —CH(CN)-(CONHR') in which R' and R'' represent each an aliphatic group, an aromatic group or a heterocyclic group and the desirable examples thereof include the same groups as those given in the case of $R_4$.

In Formula [I], $R_1$ preferably represents an $R_3O$— group, an $R_4$—$SO_2NH$— group, an $(R_5)(R_6)(P{=}O)$—NH— group, N≡C—NH— group, an $(R_7)(R_8)N$— group and an $(R_9)(R_{10})C{=}N$— group. Among these groups, the $R_3O$— groups, $R_4$—$SO_2NH$— groups and N≡C—NH— groups are desirable and the $R_4$—$SO_2NH$— groups is preferable.

In Formula [I], the substitutable groups represented by X include, for example, the following groups; namely, a straight-chained, a branched or a cyclic alkyl, alkenyl or alkynyl group including preferably those having each 1 to 20 carbon atoms, an aryl group including, for example, a phenyl group, an alkoxy group including preferably those comprising each an alkyl component having 1 to 20 carbon atoms, an alkenyloxy group including, for example, an allyloxy group and a butenyloxy group, an alkynyloxy group including, for example, a propargyloxy group and a butynyloxy group, an aryloxy group including, for example, a phenoxy group, an acyloxy group including, for example, an acetyloxy group, a propionyloxy group and a benzoyloxy group, an acylamino group including, for example, an acetylamino group, a propionylamino group, a butanoylamino group, a propionylamino group, an octanoylamino group and a benzoylamino group, a sulfonamido group including, for example, a methanesulfonamido group, an ethanesulfonamido group, a propanesulfonamido group, a butanesulfonamido group, a hexanesulfonamido group, an octanesulfonamido group, a dodecanesulfonamido group and a benzenesulfonamido group, a ureido group including, for example, a methylureido group, an ethylureido group, a propylureido group, a butylureido group, a hexylureido group, a cyclohexylureido group, an octylureido group, a dodecylureido group, an octadecylureido group, a phenylureido group and a naphthylureido group, an oxamoylamino group including, for example, a methyloxamoylamino group, an ethyloxamoylamino group, a butyloxamoylamino group, an octyloxamoylamino group and a phenyloxamoylamino group, a hydrazinocarbonylamino group including, for example, a methyl-hydrozinocarbonylamino group, an ethylhydrazinocarbonylamino group, a dimethylhydrazinocarbonylamino group, a diphenylhydrazinocarbonylamino group and a phenylmethylhydrazinocarbonylamino group, an alkylamino group including, for example, a methylamino group, an ethylamino group, a butylamino group, an octylamino group and a dodecylamino group, a dialkylamino group including, for example, a dimethylamino group, a diethylamino group, a dibutyl-amino group and a methyloctylamino group, an amino group, a hydroxy group, a halogen atom, an alkylthio group including preferably those comprising each an alkyl component having 1 to 20 carbon atoms, an alkenylthio group including, for example, an allylthio group and a butenylthio group, a mercapto group, a sulfo group, a carboxy group, and a thioureido group including, for example, a methylthioureido group, an ethylthioureido group, an octylthioureido group, a dodecylthioureido group and a phenylthio-ureido group. The above-given groups may further be substituted each with a suitable substituent including, for example, the groups given as the examples of the suitable substituents which may be substituted further to the aliphatic, aromatic or heterocyclic groups represented by $R_3$ in the $R_3O$— groups given in the case of the foregoing $R_1$.

In Formula [I], $A_1$ and $A_2$ represent each a hydrogen atom or one of them represents a hydrogen atom and the other one represents an acyl group including, for example, an acetyl group, a trifluoroacetyl group and a benzoyl group, a sulfonyl group including, for example, a methanesulfonyl group and a toluenesulfonyl group, or an oxalyl group including, for example, an ethoxalyl group.

$A_1$ and $A_2$ preferably represent each a hydrogen atom.

In Formula [1], when $R_2$ represents an —O—$R_{11}$ group, $R_{11}$ represents an alkenyl group including, for example, an allyl group and a butenyl group, an alkynyl group including, for example, a propargyl group and a butynyl group, an aryl group including, for example, a phenyl group and a naphthyl group or a heterocyclic group including, for example, a saturated heterocyclic group such as a piperidinyl group, a pyrrolidinyl group, a quinuclidinyl group, a tetrahydrofuryl group and a sulforanyl group and an unsaturated heterocyclic group such as a pyridyl group, a pyrimidinyl group, a thienyl group and a furyl group.

$R_{11}$ preferably represents an alkynyl group or a saturated heterocyclic group.

In Formula [I], when $R_2$ represents an —$N(R_{12})(R_{13})$ group, $R_{12}$ represents a hydrogen atom, an aliphatic group including, for example, an alkyl group such as a methyl group, an ethyl group, a butyl group, a cyclohexyl group and an octyl group, an alkenyl group such as an allyl group and a butenyl group, and an alkynyl group such as a propargyl group and a butynyl group, an aromatic group including, for example, a phenyl group or a naphthyl group or a heterocyclic group including, for example, a saturated heterocyclic group such as a piperidinyl group, a pyrazolidinyl group, a quinuclidinyl group, a pyrrolidinyl group, a tetrahydrofuryl group and a sulforanyl group, or an unsaturated heterocyclic group such as a pyridyl group, a pyrimidinyl group, a thienyl group and a furyl group; and $R_{13}$ represents an alkenyl group including, for example, an allyl group and a butenyl group, an alkynyl group including, for example, a propargyl group and a butynyl group, an aryl group including, for example, a phenyl group or a naphthyl group, a hydroxy group, an alkoxy group including, for example, a methoxy group and an ethoxy group, or a heterocyclic group including, for example, a saturated heterocyclic group such as a piperidinyl group, a pyrazolidinyl group, a quinuclidinyl group, a pyrrolidinyl group, a tetrahydrofuryl group, a sulforanyl group, and an unsaturated heterocyclic group such as a pyridyl group, a pyrimidinyl group, a thienyl group and a furyl group.

$R_{12}$ preferably represents a hydrogen atom, an aliphatic group or an aromatic group, and $R_{13}$ preferably represents an alkenyl group, an alkynyl group or a saturated heterocyclic group.

In Formula [I], the foregoing substituents given for the —O—$R_{11}$ and —$N(R_{12})(R_{13})$ each represented by $R_2$ may further be each substituted by a suitable substituent including, for example, the groups given as the examples of the suitable substituents which may be substituted to the aliphatic, aromatic or heterocyclic groups represented by $R_3$ in the $R_3O$— group represented by $R_1$.

Among the compounds represented by Formula [I], the following group is contained in at least one of $R_1$, X or $R_2$ as the component structure The —$(O—Y)_m$— group given in Formula [IV]

wherein Y represents an alkylene group including, for example, an ethylene group, a propylene group, a trimethylene group and a tetramethylene group, an alkenylene group including, for example, a vinylene group, propenylene group, a 1-butenylene group and a 2-butenylene group, an arylene group including, for example, a phenylene group, or a group having a substituent suitable for the above-given groups including, for example, the groups given as the examples of the suitable substituents which may be further substituted to the aliphatic, aromatic or heterocyclic groups represented by $R_3$ in the $R_3O$— groups represented by the foregoing $R_1$.

Y preferably represents an alkylene group and more preferably an ethylene group, a propylene group and a trimethylene group. —(O—Y)$_m$— group, wherein m is an integer of not less than 2 and more preferably not less than 3.

Next, the typical examples of the compounds of the invention represented by Formula [I] will be given below. It is, however, to be understood that the invention shall not be limited thereto.

I-1

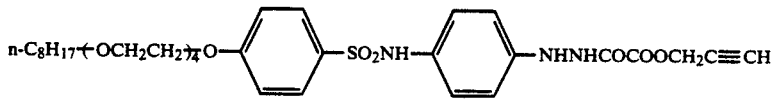

I-2

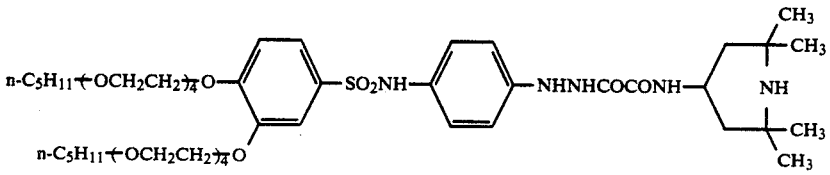

I-3

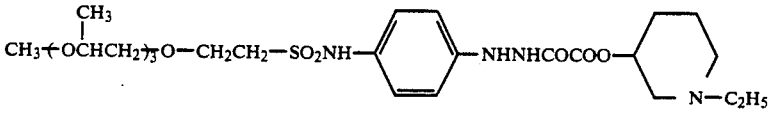

I-4

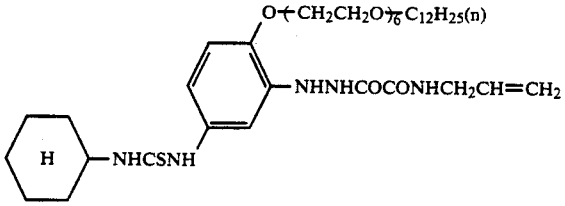

I-5

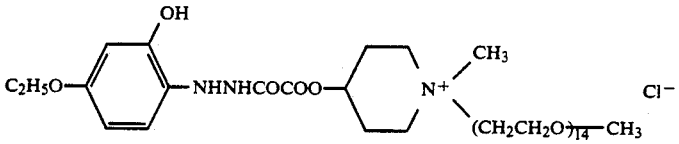

I-6

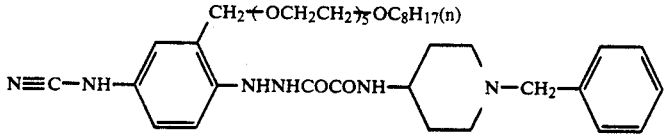

I-7

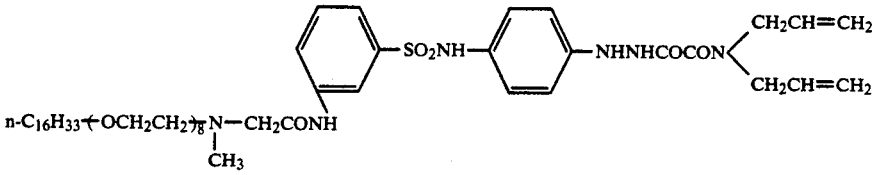

I-8

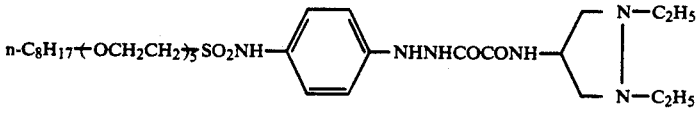

I-9

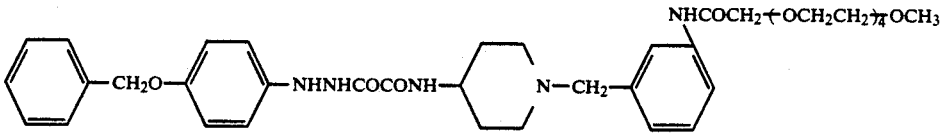

-continued
I-10
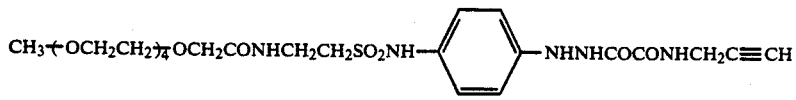
I-11
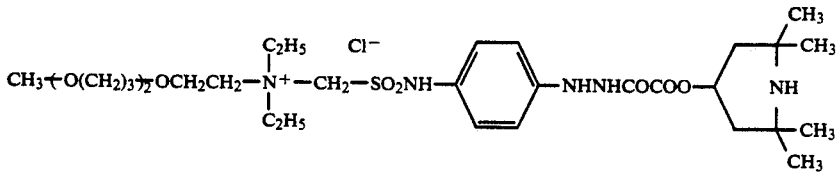
I-12
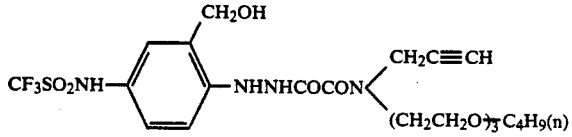
I-13
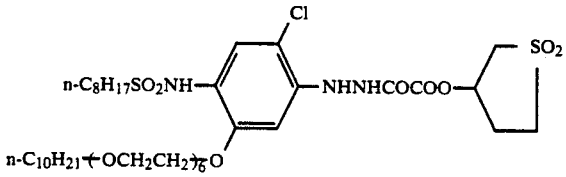
I-14
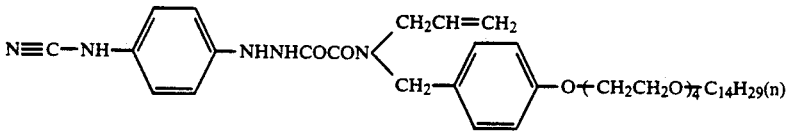
I-15
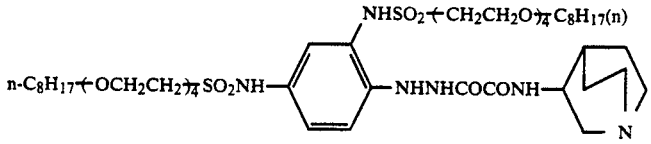
I-16
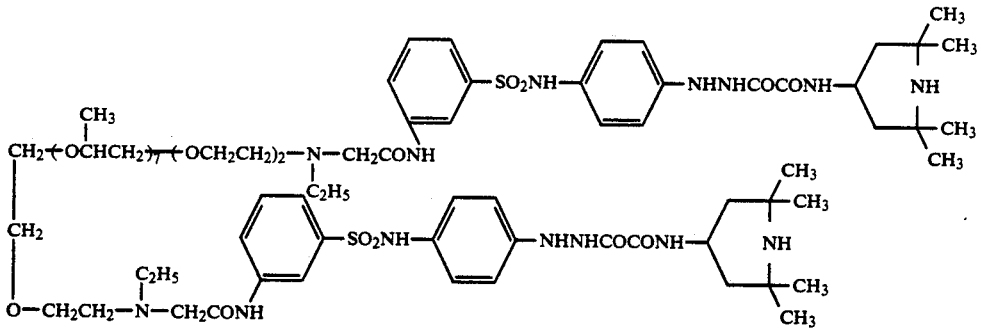
I-17
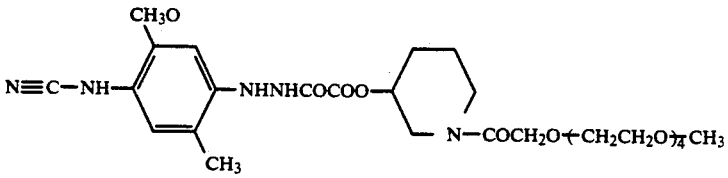

-continued
I-18
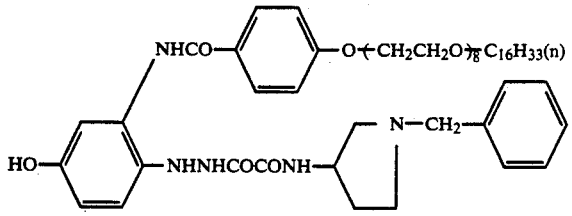
I-19
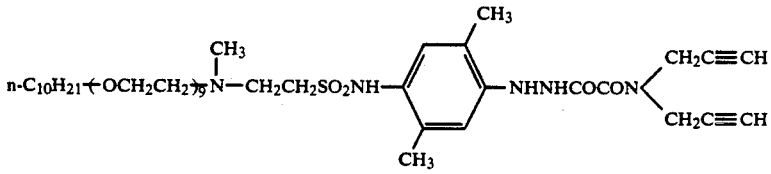
I-20
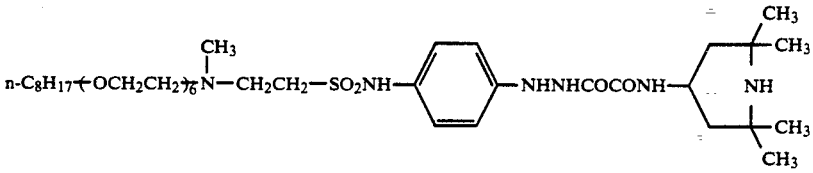
I-21
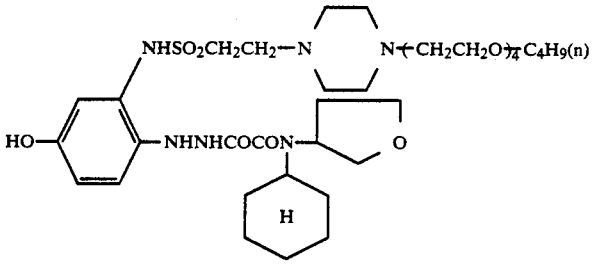
I-22
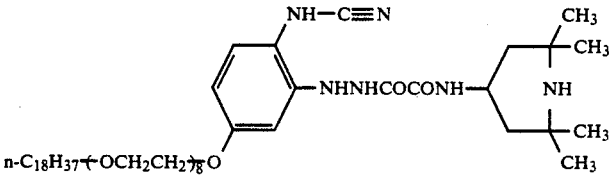
I-23
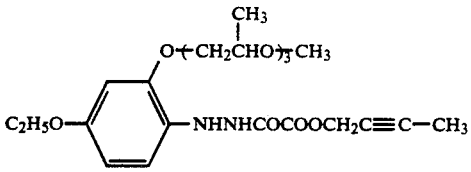
I-24
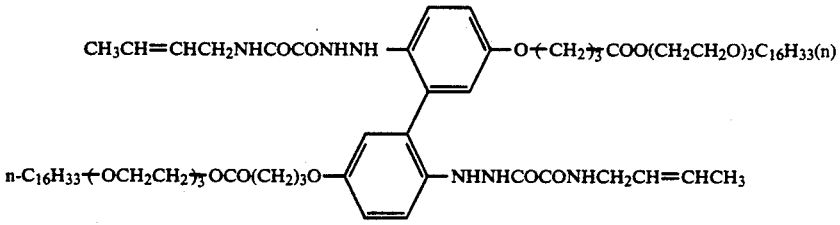
I-25
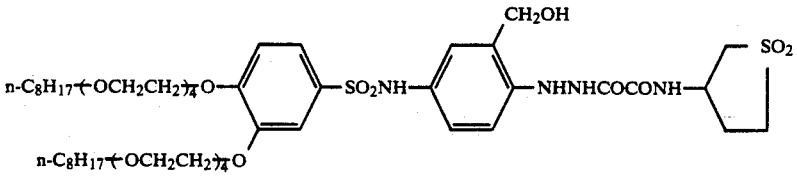

-continued
I-26
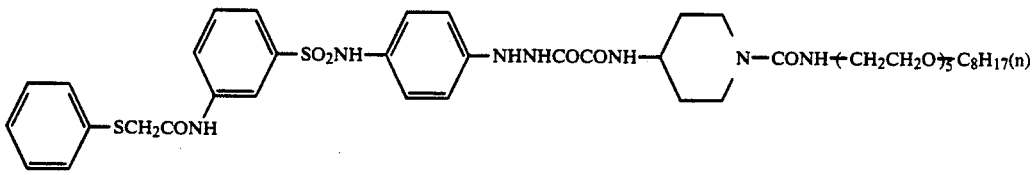
I-27
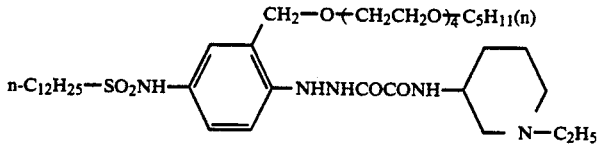
I-28
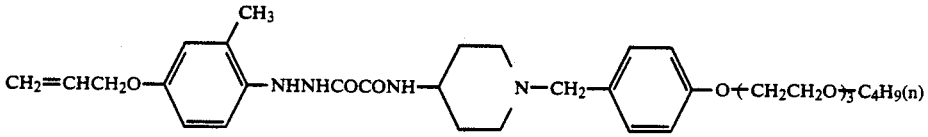
I-29
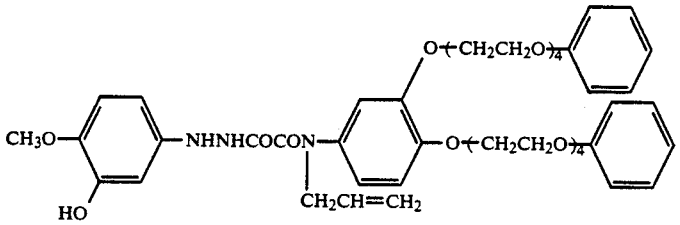
I-30
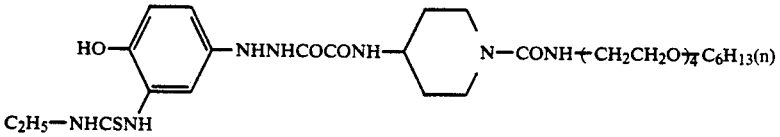
I-31
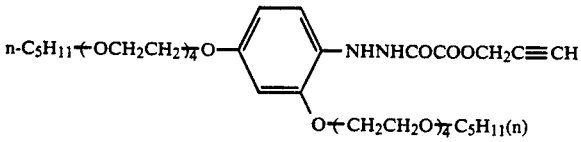
I-32
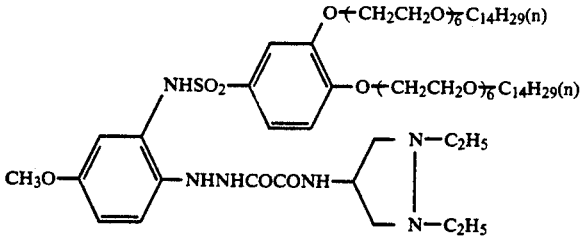
I-33
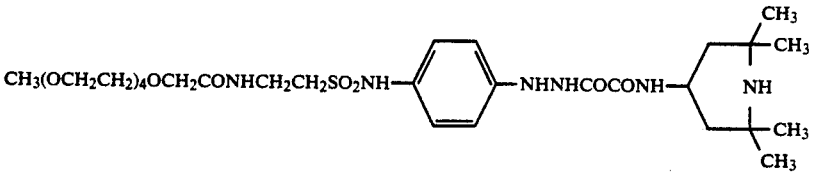

-continued
I-34
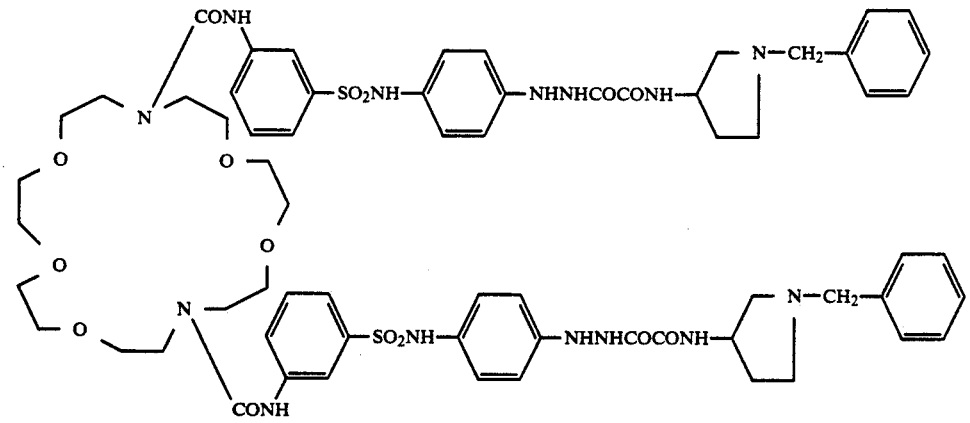
I-35
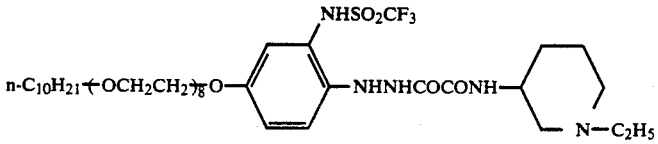
I-36
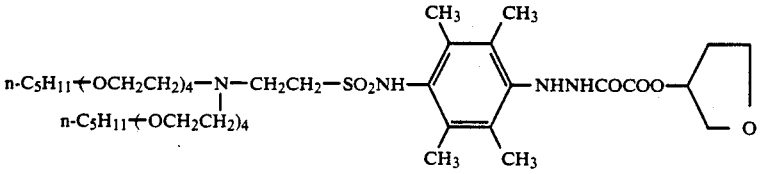
I-37
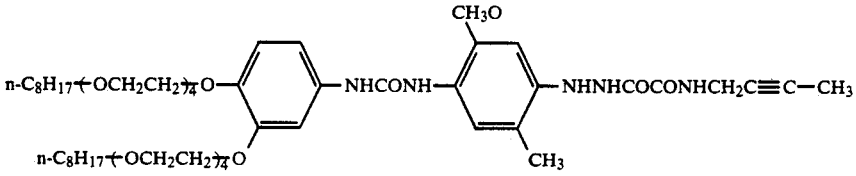
I-38
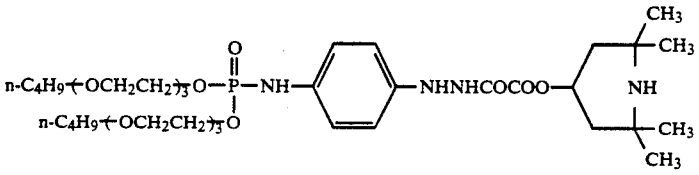
I-39
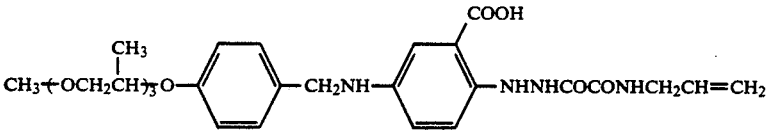
I-40
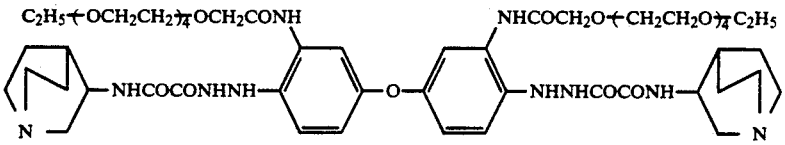
I-41
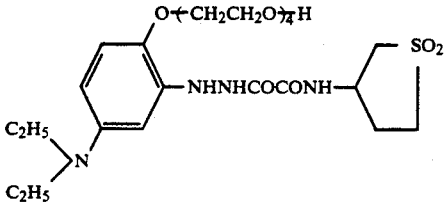

-continued
I-42
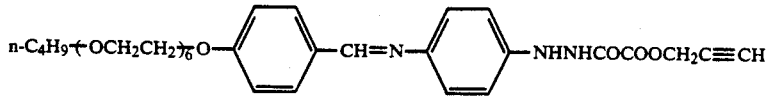
I-43
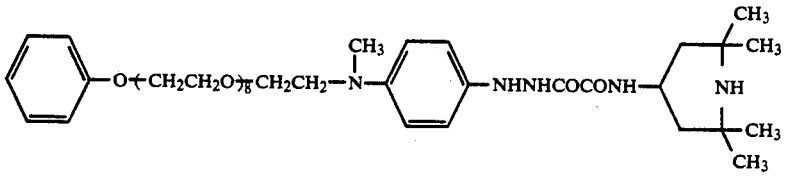
I-44
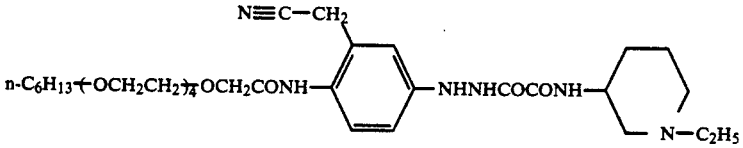
I-45
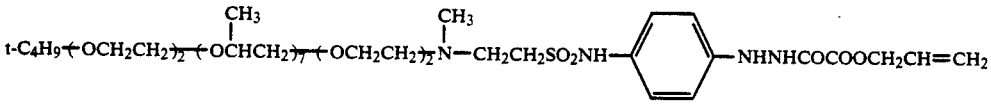
I-46
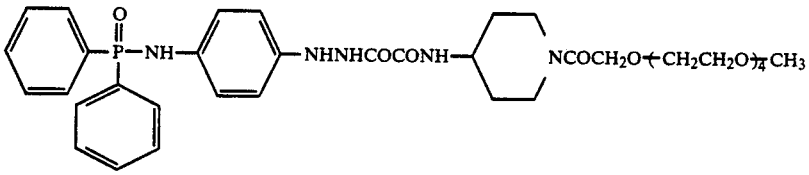
I-47
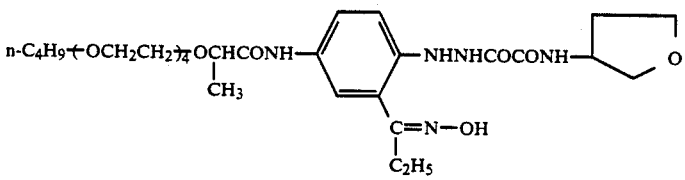
I-48
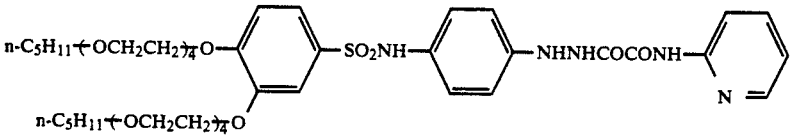
I-49
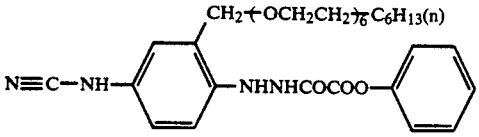
I-50
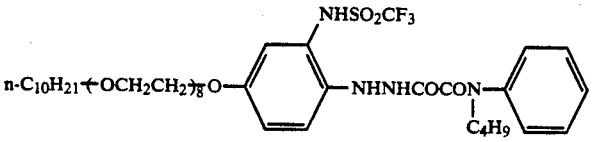
I-51
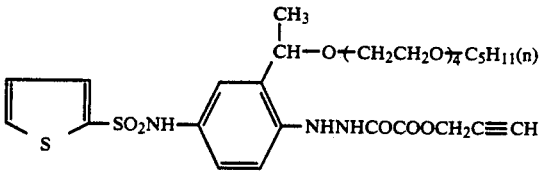

-continued
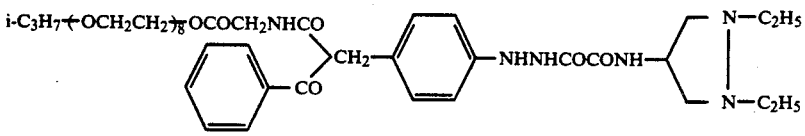
I-52
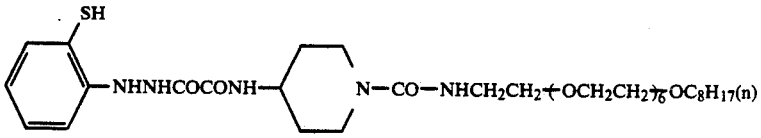
I-53
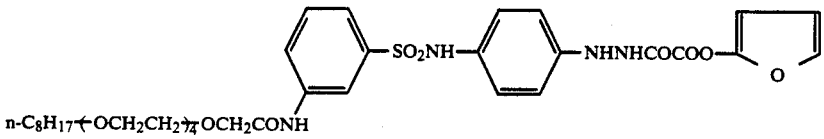
I-54
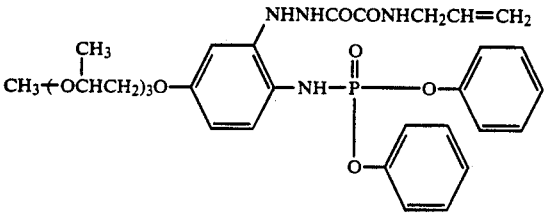
I-55
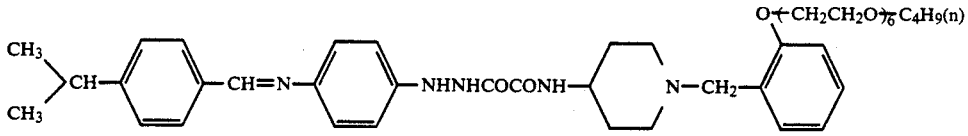
I-56
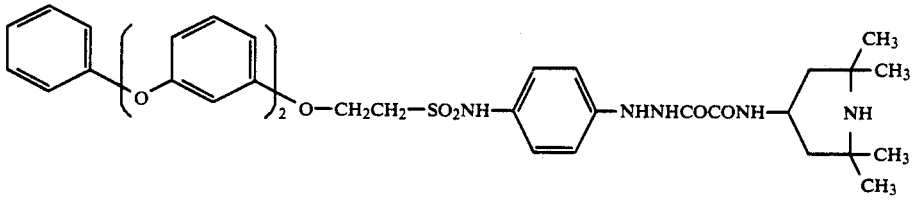
I-57
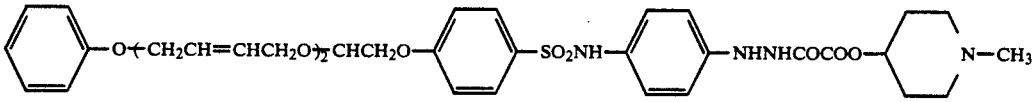
I-58
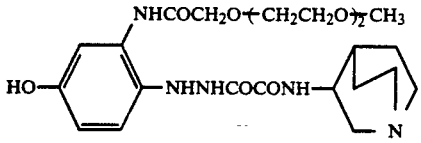
I-59
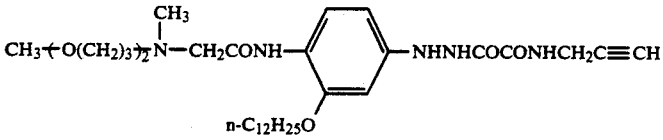
I-60

-continued
I-61
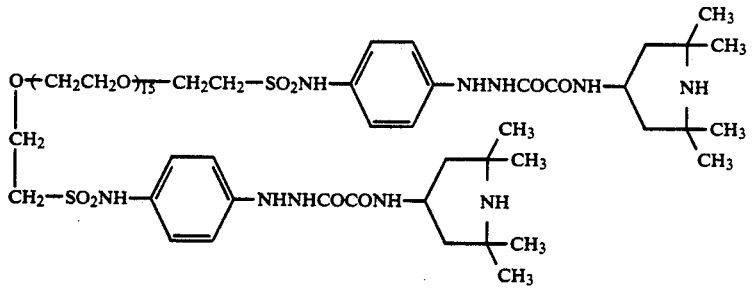
I-62
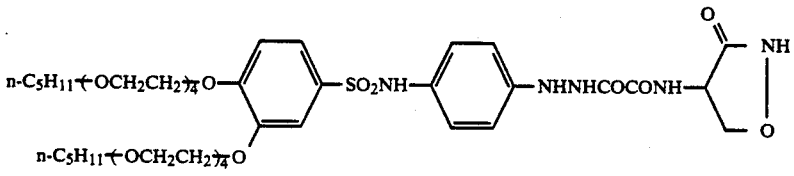
I-63
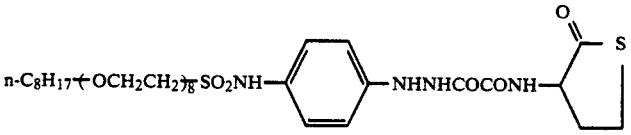
I-64
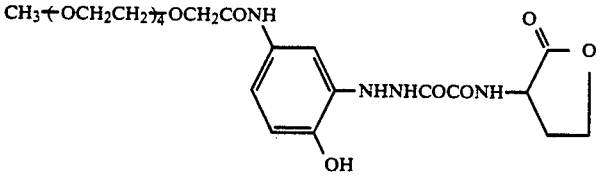
I-65
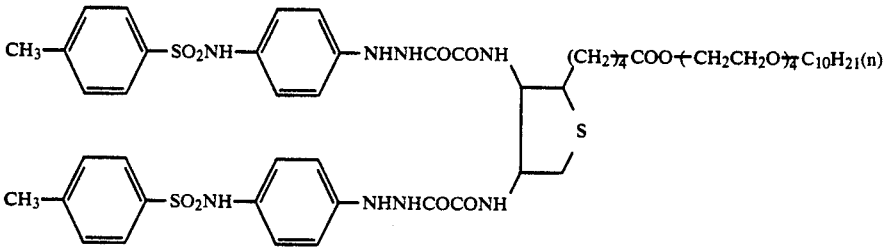
I-66
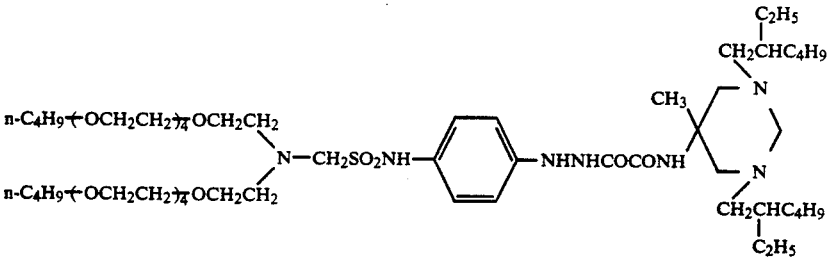
I-67
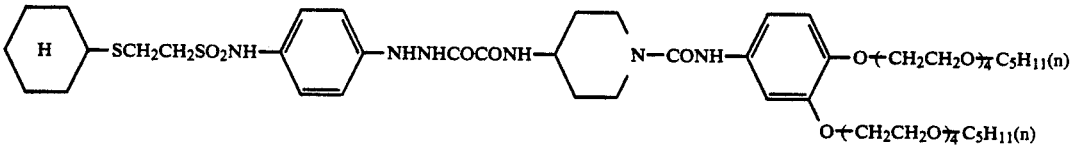
I-68
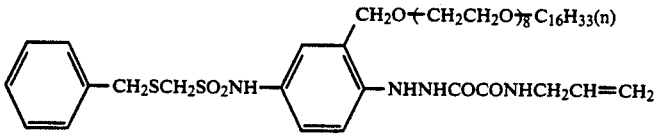

-continued
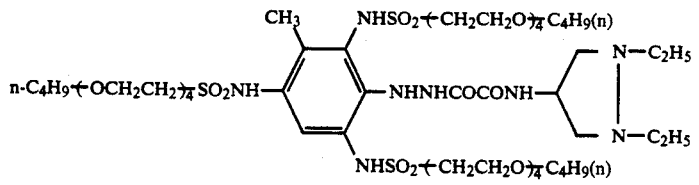
I-69
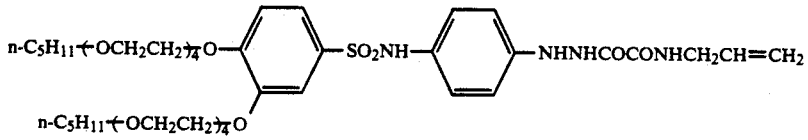
I-70
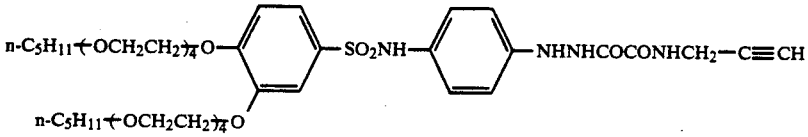
I-71
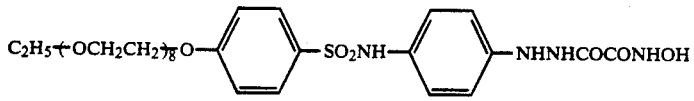
I-72
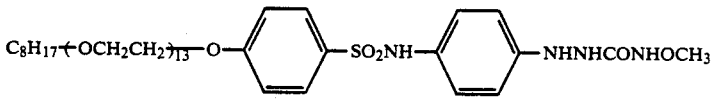
I-73
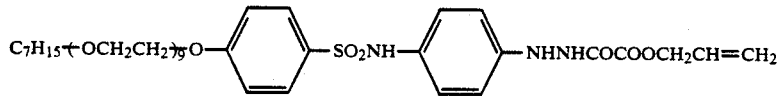
I-74
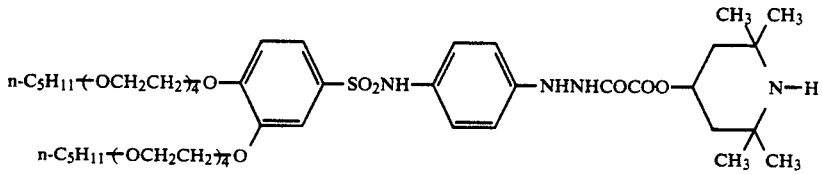
I-75
Next, the examples of the procedures for synthesizing the compounds of the invention represented by Formula [I] will be detailed below.
For example, Compound I-2 can be synthesized in the following synthesizing procedures.
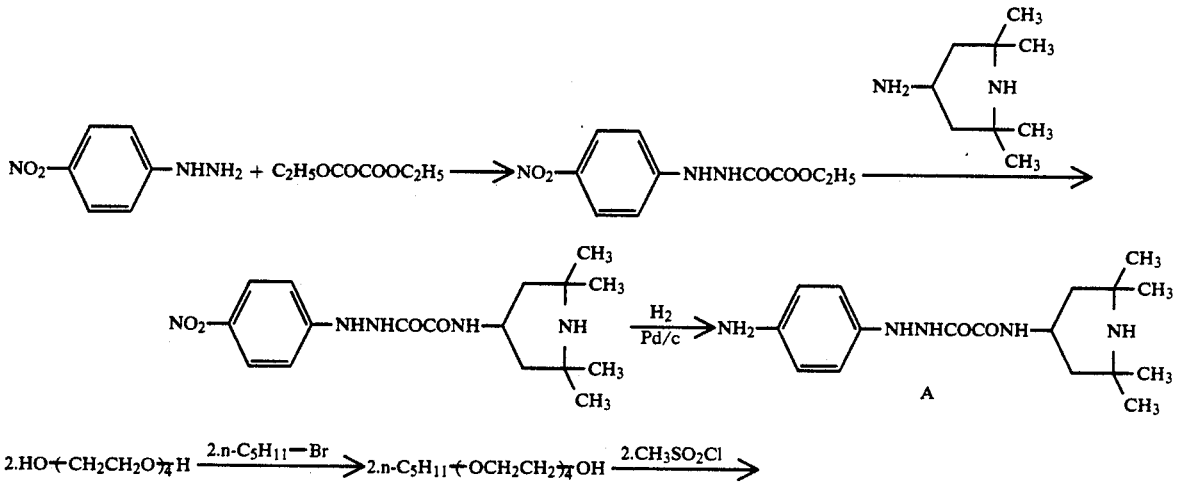

-continued
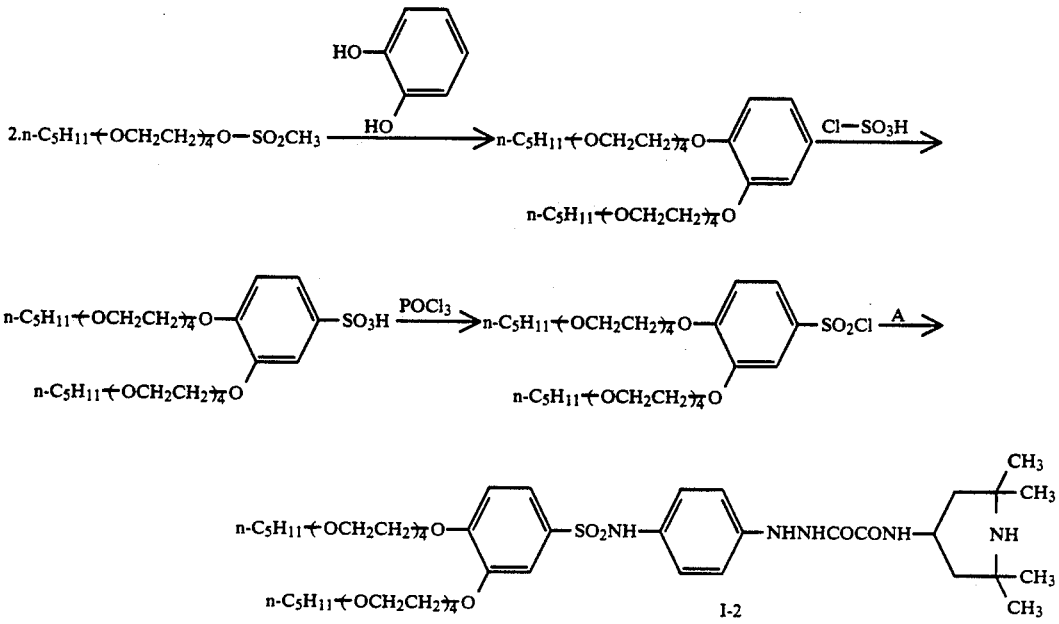
For example, Compound I-6 can be synthesized in the following synthesizing procedures.
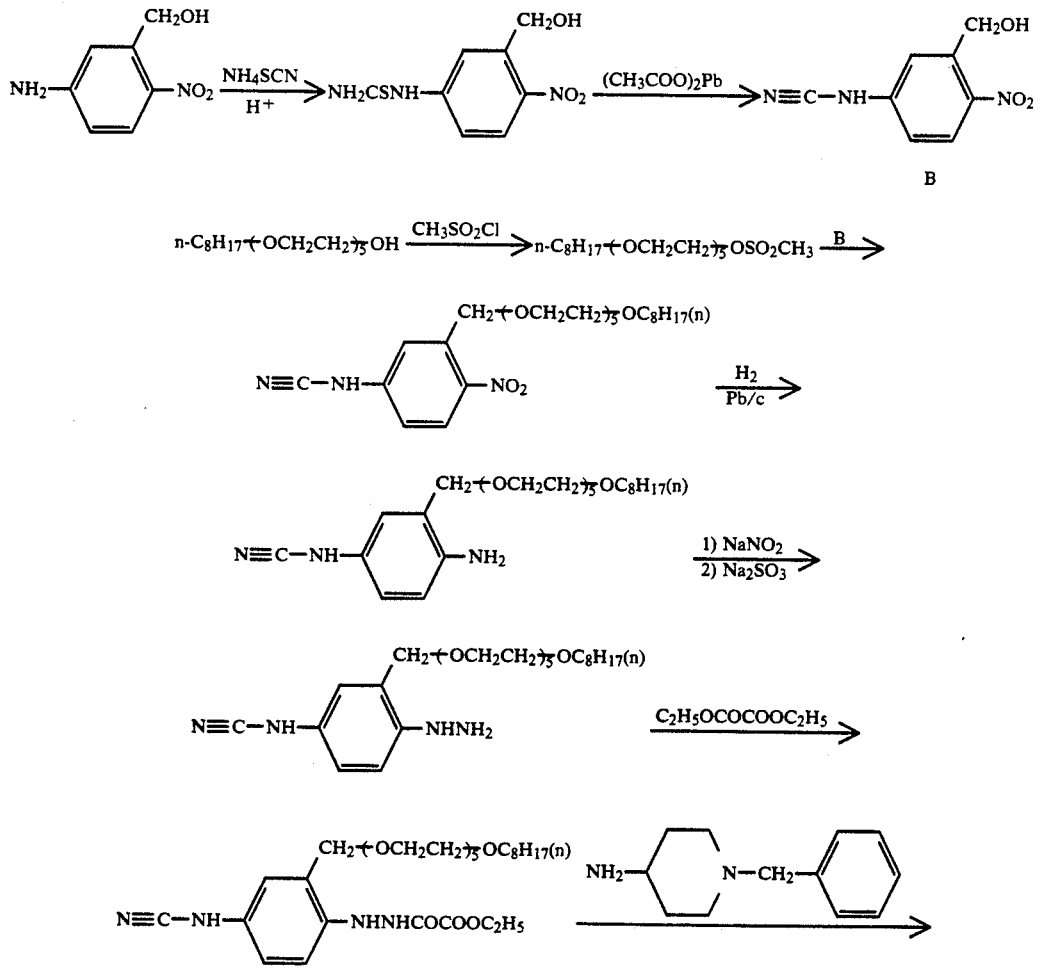

-continued

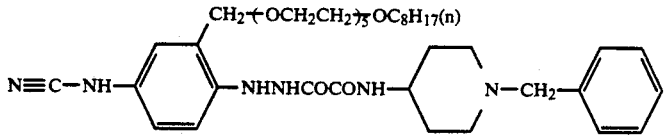

I-6

For example, Compound I-18 can be synthesized in the following synthesizing procedures.

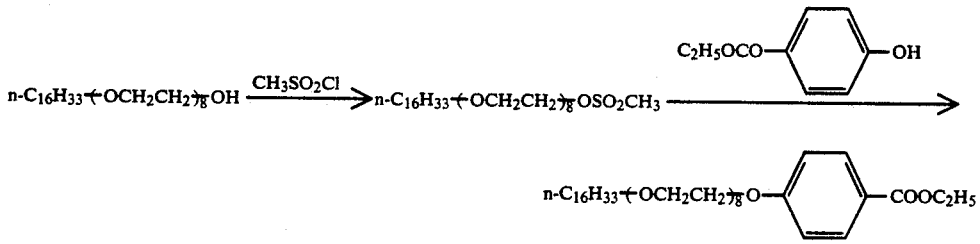

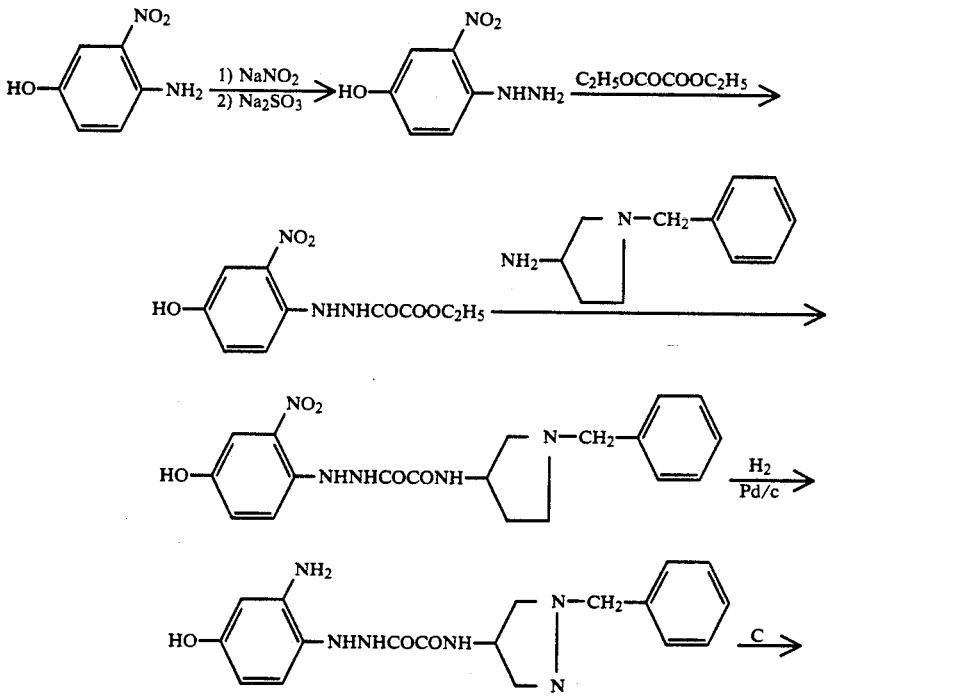

I-18

Next, the silver halide photographic light sensitive materials of the invention and, particularly, the case of the preferred embodiments thereof suitably capable of displaying high contrast photographic characteristics.

In the silver halide photographic light sensitive materials applied with the invention capable of obtaining high contrast images, at least one of the compounds represented by the above-given Formula [I] is contained as a substance functioning as a contrast increasing agent. The amount of the compound represented by Formula [I] contained in the photographic light sensitive material is to be within the range of, preferably, $5\times10^{-7}$ mols to $5\times10^{-1}$ mols per mol of the silver halides contained in the photographic light sensitive material.

Particularly, it is preferable to contain them in an amount within the range of $5\times10^{-6}$ mols to $1\times10^{-2}$ mols.

The silver halide photographic light sensitive materials of the invention are each comprised of at least one silver halide emulsion layer. To be more concrete, there may be some instances where at least one the silver halide emulsion layer is arranged onto one side or the both sides of the support. The silver halide emulsions may be coated either on the support directly or on the support by interposing another layer such as a hydrophilic colloidal layer not containing any silver halide emulsion between them. It is further allowed to coat a hydrophilic colloidal layer as a protective layer on the silver halide emulsion layer. The silver halide emulsion layer may be coated by separating it into each of the silver halide emulsion layers having different sensitivities such as a high sensitivity and a low sensitivity. In this case, an interlayer comprising hydrophilic colloid may also be arranged between each of the silver halide emulsion layers. Such an interlayer may further be arranged between a silver halide emulsion layer and a protective layer. In other words, it required, it is allowed to arrange non-light-sensitive hydrophilic colloidal layers such as an interlayer, a protective layer, an antihalation layer and a backing layer.

In order to contain the compound represented by Formula [I] in the silver halide photographic light sensitive materials of the invention so as to function it as a contrast increasing agent, it is preferable to contain it in the hydrophilic colloidal layers of the light sensitive materials and it is particularly preferable to contain it in the silver halide emulsion layers and/or the hydrophilic colloidal layers adjacent to the silver halide emulsion layers.

Next, the silver halides applicable to the silver halide photographic light sensitive materials of the invention will now be detailed below. As for the silver halides, those having any prefered compositions can be used. They include, for example, silver chloride, silver bromide, silver chloroiodide, pure silver bromide, silver iodobromide and silver chloroiodobromide. The average grain sizes of the above-mentioned silver halides preferably applied are within the range of 0.05 to 0.5 μm and, among them, those having an average grain size within the range of 0.10 to 0.40 μm may suitably be used.

Any prefered grain size distributions of the silver halide grains applicable to the invention may be used. However, the monodispersibility defined below is so controlled as to be within the range of, preferably, 1 to 30 and, more preferably, 5 to 20.

The above-mentioned monodispersibility is defined by the following formula.

$$\text{Monodispersibility} = \frac{\sqrt{\Sigma(\bar{r}-ri)^2 ni}}{\Sigma ni} \div \bar{r} \times 100$$

The above-mentioned monodispersibility is defined as a value 100 times as much as a value obtained by dividing a standard deviation of grain size distribution by an average grain size ($\bar{r}$). For convenience, the silver halide grain sizes are indicated by the edge length of a cubic crystal grain and the other grains (having an octahedron, tetradeca hedron and so forth) are calculated out by the square root of a projective area thereof.

When embodying the invention, silver halide grains of the type having at least two or more multilayered structure, for example, can be used as the silver halide grains. It is allowed to use, for example, silver chlorobromide grains or silver chloroiodobromide grains each having the core portions comprising silver chloride or silver iodobromide and the shell portions comprising silver bromide, or, inversely, those having the core portions comprising silver bromide and the shell portions comprising silver chloride. In this case, iodide may be contained in any one of the layers. However, the iodide content is preferably in an amount of not more than 5 mol %.

In the course of forming nucleus grains and/or growing them, the silver halide grains applicable to the silver halide emulsions of the invention can be doped with metal ions by making use of at least one kind selected from the group consisting of cadmium salts, zinc salts, lead salts, thallium salts, iridium salts (including the complexes thereof), rhodium salts (including the complexes thereof) and iron salts (including the complexes thereof), so that those metal elements can be contained inside the grains and/or on the surfaces thereof. It is, further, allowed that a reduction sensitization nuclei can be provided into the inside of the grains and/or onto the surfaces thereof by putting them in a suitable reducible atmosphere.

In addition to the above, it is allowed that silver halides can be sensitized with various kinds of chemical sensitizers. The sensitizers include, for example, active gelatin, sulfur sensitizers (such as sodium thiosulfate, allyl thiocarbamide, thiourea and allyl isocyanate), selenium sensitizers (such as N,N-dimethyl selenourea and selenourea), reduction sensitizers (such as triethylene tetramine and stannous chloride) and various kinds of metal sensitizers including, typically, potassium chloroaurite, potassium aurothiocyanate, potassium chloroaurate, 2-aurosulfobenzothiazole methyl chloride, ammonium chloropalladate, potassium chloroplatinate and sodium chloropalladate. The above-given sensitizers may be used independently or in combination. When making use of a gold sensitizer, ammonium thiocyanate may also be used as an sensitization-promoting agent.

When applying the invention to a light sensitive material capable of obtaining a high contrast image, the characteristics of the light sensitive material can be enhanced by processing it with the above-given chemical sensitizers, because the invention can preferably be applied to a light sensitive material comprising silver halide grains, that is the so-called negative-image providing silver halide grains having the surface sensitivity higher than the internal sensitivity.

The silver halide emulsions applicable thereto can be stabilized or fog-inhibited by making use of a mercapto compound (such as 1-phenyl-5-mercaptotetrazole and 2-mercaptobenzthiazole), a benzotriazole (such as 5-bromobenzotriazole and 5-methylbenzotriazole) and a benzimidazole (such as 6-nitrobenzimidazole). (It is also allowed to add a sensitizing dye, a plasticizer, a surfactant, a hardener, a development accelerator and so forth to the silver halide emulsions applicable to the invention.)

When adding the compounds represented by Formula [I] of the invention to a hydrophilic colloidal layer, gelatin is suitable for the binder for the hydrophilic colloidal layers and other hydrophilic colloids than gelatin may also be applicable thereto.

When embodying the invention, the supports applicable to the light sensitive materials capable of obtaining high contrast images include, for example, baryta paper, polyethylene-coated paper, polypropylene synthetic paper, glass plate, cellulose acetate, cellulose nitrate and polyester film such as those made of polyethylene terephthalate. These supports may be so selected as to meet the application purposes of a subject silver halide photographic light sensitive material.

When a silver halide photographic light sensitive material capable of obtaining a high contrast image is to be developed, the following developing agents for example are used.

The typical HO—(CH=CH)$_n$—OH type developing agents include hydroquinone and, besides, catechol, pyrogallol and so forth.

The typical HO—(CH=CH)$_n$—NH$_2$ type developing agents include an ortho and para aminophenol or aminopyrazolone and, besides, N-methyl-p-aminophenol, N-$\beta$-hydroxyethyl-p-aminophenol, p-hydroxyphenylaminoacetic acid, 2-aminonaphthol and so forth.

The heterocyclic type developing agents include, for example, 3-pyrazolidones such as 1-phenyl-3-pyrazolidone, 1-phenyl-4,4-dimethyl-3-pyrazolidone, 1-phenyl-4-methyl-4-hydroxymethyl-3-pyrazolidone.

Besides the above, the developing agents effectively applicable to the invention include those given in T. H. James, 'The Theory of the Photographic Process', Fourth Edition, pp.291~334; and 'Journal of the American Chemical Society', Vol.73, p.3,100, (1951). These developing agents may be used independently or in combination. It is, however, preferable to use them in combination. (In the case of making an independent use, hydroquinone is preferably used and, in the case of making combination use, the combination of hydroquinone and 1-phenyl-3-pyrazolidone or the combination of hydroquinone and N-methyl-p-aminophenol is preferably used.)

The effects of the invention cannot be spoiled, even when making use of a preservative including, for example a sulfite such as sodium sulfite and potassium sulfite, in a developing solution used for developments. A hydroxylamine or hydrazine compound may also be used as a preservative. Besides, it is also allowed, if prefered, to provide a pH controlling or buffering function by making use of caustic alkali, carbonic acid alkali or amine which is generally used in black-and-white developing solutions and it is further allowed, if required, to add the additives including, for example, an inorganic development retarder such as potassium bromide, an organic development retarder such as benzotriazole, a metal-ion scavenger such as ethylenediamine tetraacetic acid, a development accelerator such as methanol, ethanol and benzyl alcohol, a surfactant such as naphthol alkylarylsulfonic acid, natural saponin, sugar and the alkyl esters of the above-given compounds, a hardener such as glutaraldehyde, formalin and glyoxal and an ionic strength controller such as sodium sulfate.

For the purposes of increasing a sensitivity and contrast or accelerating a development speed in the invention, light sensitive silver halide emulsions and the layers adjacent thereto may also contain an amine compound, a hydrazine compound, an onium salt compound or a polyalkylene oxide compound. When making an independent or combination use of these compounds, the characteristics of the invention can be enhanced. The typical examples of these compounds include the nucleation accelerating compounds given in JP OPI Publication No. 4-51143/1992 and the typical examples of the compounds represented by Formula [P]; $R_1$—O—(CH$_2$CH$_2$O)$_n$H; which is given in the same Patent Application.

Next, an embodiment preferred in the case where a light sensitive material of the invention is utilized as a direct-positive type silver halide photographic light sensitive material will be detailed below.

In this case, the compounds represented by Formula [I] can each be functioned as a foggant. When making use of the compounds each represented by Formula [I] as a foggant, the compounds mentioned above are each hereinafter referred to as 'a foggant of the invention'.

At least one of the foggants of the invention may be made present so that an internal latent image type silver halide emulsion that is an emulsion for providing a direct positive type image may be fogged, after making an imagewise exposure and when carrying out a development process. In other words, after exposing to light a photographic light sensitive material containing an internal latent image type silver halide emulsion, the foggant of the invention may be contained in the light sensitive material so that a development process can be carried out in the presence of the foggant of the invention.

In a preferred embodiment, at least one of the foggants of the invention is contained in a silver halide emulsion layer or the layer adjacent thereto (such as a silver halide light sensitive layer, an interlayer, a filter layer, a protective layer and an antihalation layer).

The amounts of the foggants of the invention used may be varied in a wide range according to the characteristics of a subject silver halide emulsion, the kinds of the foggants and the development conditions. However, the amounts thereof may be good enough, provided, after a photographic light sensitive material containing an internal latent image type silver halide emulsion is exposed imagewise to light and is then developed with a surface developing solution, a fogging function can be provided as much as a positive image can be obtained. It is prefered to be an amount thereof capable of providing a satisfactory maximum density (such as a density of not lower than 2.0) after completing the development process.

For containing the foggants of the invention in a silver halide emulsion, it is prefered to contain them in an amount within the range of the order of $10^{-5}$ mols to $10^{-1}$ mols per mol of silver halides used.

When embodying the invention, the silver halide developing agents applicable to the development processes include, for example, a hydroquinone, a catechol, an aminophenol, a 3-pyrazolidone, ascorbic acid and the derivatives thereof, a reductone, a phenylenediamine and the mixtures thereof. It is also allowed to contain these developing agents in advance in an emulsion, so that they may be able to work on the silver halide in the course of dipping in an aqueous high pH solution.

When embodying the invention, the development components, which are used in the development processes of direct positive type silver halide photographic light sensitive materials, may further contain a specific antifoggant and a development inhibitor, or these development components may also be incorporated optionally into the layers of a silver halide photographic light sensitive material. The generally useful antifoggants include, for example, benzothiazoles such as benzotriazoles and 5-methylbenzothiazole; heterocyclic thiones such as 1-phenyl-5-mercaptotetrazole, 5-methylbenzotriazole and 1-methyl-2-tetrazoline-5-thione; and aromatic and aliphatic mercapto compounds.

In the case of applying the invention to a direct-positive type silver halide photographic light sensitive material, the silver halide emulsions thereof are of the internal latent image type, that is, those comprising silver halide grains capable of forming a latent image mainly inside the grains and having most of the light sensitive nuclei inside the grains. The silver halides for forming the emulsions include any prefered silver halides such as silver bromide, silver chloride, silver chlorobromide, silver iodobromide and silver chloroiodobromide.

In the case where a sample comprising the emulsion used in the above-mentioned case coated on the transparent support thereof is partly exposed to a light intensity scale for a certain specific time upto about one second and is then developed at 20° C. for 4 minutes with the following surface developing solution A without substantially containing any silver halide solvent and capable of developing only the latent images on the grain surfaces, it is particularly prefered that the emulsions show a maximum density not higher than 1/5 of a maximum density obtained in the case where another sample containing the same emulsion is partly exposed to light and is the developed at 20° C. for 4 minutes with the following internal type developing solution B capable of developing the latent images inside the grains. It is also prefered that a maximum density obtained when making use of surface developing solution A is to be not higher than 1/10 of a maximum density obtained when making use of internal type developing solution.

| | |
|---|---|
| Surface developing solution A | |
| Metol | 1.5 g |
| L-ascorbic acid | 10 g |
| $NaBO_2.4H_2O$ | 20 g |
| KBr | 1 g |
| Add water to make | 1 liter |
| Internal type developing solution B | |
| Metol | 2.0 g |
| Sodium sulfite, anhydrous | 90.0 g |
| Hydroquinone | 8.0 g |
| Sodium carbonate hydrate | 52.5 g |
| KBr | 5.0 g |
| KI | 0.5 g |
| Add water to make | 1 liter |

The internal latent image type silver halide emulsions include those prepared in various methods. For example, a conversion type silver halide emulsion such as those detailed in U.S. Pat. No. 2,592,250; a silver halide emulsion comprising internally, chemically sensitized silver halide grains such as those detailed in U.S. Pat. Nos. 3,206,316, 3,317,322 and 3,367,778 and JP Examined Publication No. 43-29405/1968; a silver halide emulsion comprising silver halide grains incorporated with polyvalent metal ions such as those detailed in U.S. Pat. Nos. 3,271,157, 3,447,927 and 3,531,291; a silver halide emulsion comprising grains having a multilayered structure such as those detailed in JP OPI Publication No. 50-8524/1975; or a silver halide emulsion containing silver iodide, which is prepared in an ammoniacal method, such as those detailed in JP Application No. 51-74062/1976.

Further, when the internal latent image type silver halide emulsions applicable thereto contain a compound having an azaindene ring and a nitrogen-containing heterocyclic compound having a mercapto group in an amount within the range of, preferably, 1 mg to 10 g per mol of the silver halide content thereof, the minimum density can be more lowered and the more stable results can also be enjoyed.

The compounds having each an azaindene ring include, preferably, 4-hydroxy-6-methyl-1,3,3a,7-tetrazaindene. The nitrogen-containing heterocyclic compounds having each a mercapto group include, for example, a pyrazole ring, a 1,2,4-triazole ring, a 1,2,3-triazole ring, a 1,3,4-thiadiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, a 1,2,4-triazine ring, a 1,3,5-triazine ring, a ring condensed with the above-given 2 to 3 rings such as a triazolotriazole ring, a diazaindene ring, a triazaindene ring, a tetrazaindene ring and a pentazaindene ring, and a phthaladinone ring and an indazole ring. Among them, 1-phenyl-5-mercaptotetrazole is preferred.

The silver halide photographic light sensitive materials of the invention including particularly those applied each as a positive type light sensitive material can be served as any one of a black-and-white photographic light sensitive material and a monochromatic or multicolor photographic light sensitive material. In the case of a full-color light sensitive material, it is prefered to constitute it to have a blue-, green- and red-light sensitive layers. In this case, a photographic light sensitive material is usually comprised of a blue-light sensitive silver halide emulsion layer containing a yellow coupler, a green-light sensitive emulsion layer containing a magenta coupler and a red-light sensitive silver halide emulsion layer containing a cyan coupler.

In a preferable embodiment, a blue-light sensitive layer, a green-light sensitive layer and a red-light sensitive layer are arranged in this order from the farther side from a support and, between the blue-light sensitive layer and the green-light sensitive layer, a non-light-sensitive layer (or a filter layer) is interposed.

The above-mentioned yellow couplers preferably applicable thereto include the known acylacetanilido type couplers and, among them, a benzoylacetanilido or pivaloylacetanilido type compound are suitable for this purpose.

The above-mentioned magenta couplers applicable thereto include a 5-pyrazolone type coupler, a pyrazoloazole type coupler and an open-chained acylacetanilido type coupler.

The above-mentioned cyan couplers applicable thereto include a naphthol type coupler and a phenol type coupler.

The above-mentioned light sensitive silver halide emulsion layers and the non-light-sensitive layer for a yellow filter layer can be arranged onto a support. Besides the above, a large number of various photographic component layers such as an interlayer, a protective layer, a sublayer. a backing layer and an antihalation layer can be arranged. As for the methods for coating these layers, a dip-coating method, an air-doctor coating method, an extrusion coating method, a slide-hopper coating method, a curtain coating method and so forth can be applied.

When preparing a direct-positive type silver halide photographic light sensitive material, the support for them include, for example, those made of a polyethylene terephthalate film subbed if required, polycarbonate film, polystyrene film, polypropylene film, cellulose acetate film, glass, baryta paper and polyethylene-laminated paper.

The above-mentioned supports may be either opaque or transparent and they are selected so as to meet the purposes of the subject light sensitive materials.

According to the purposes of the silver halide emulsions of a light sensitive material, it is also allowed to add thereto a variety of photographic additives such as a wetting agent, a physical layer property improver and a coating aid. Further as the other photographic additives, it is also allowed to use a gelatin plasticizer, a surfactant, a UV absorbent, a pH controller, an antioxidizer, an antistatic agent, a thickener, a graininess improver, a dye, a mordant, a whitening agent, a development speed controller and a matting agent.

It is useful to use a UV absorbent capable of preventing a color fading produced by the short wavelength active rays of a dye image, such as a thiazolidone, benzotriazole, acrylonitrile or benzophenone type compound.

The above-mentioned silver halide emulsion layers may be used with a protective colloid or a binder such as gelatin and a suitable gelatin derivatives which may be selected to meet the purposes, and the emulsions may also contain other hydrophilic binder so as to meet the purposes. These additives may be added to meet the purposes into the photographic component layers such as an emulsion layer, an interlayer, a protective layer, a filter layer and a backing layer. Further, the above-mentioned hydrophilic binders may contain a suitable plasticizer and a wetting agent so as to meet the purposes.

Each of the component layers can be hardened by any prefered, suitable hardener.

Further, the light sensitive materials are also allowed to contain an antistaining agent AS.

EXAMPLES

The typical examples of the invention will be detailed below, but the embodiments of the invention shall not be limited thereto.

EXAMPLE 1

Preparation of Silver Halide Emulsion A

A silver iodobromide emulsion (having a silver iodide content of 2 mol % per mol of silver) was prepared in a double-jet precipitation method. When carrying out the double-jet precipitation method, $K_2IrCl_6$ was added thereto in an amount of $8\times10^{-7}$ mols per mol of silver.

The resulting emulsion was an emulsion comprising the cubic monodisperse type grains (of a variation coefficient of 9.5%) having an average grain size of 0.20 μm. After adding an aqueous 1% potassium iodide solution in an amount of 6.5 ml per mol of silver into the emulsion, a denatured gelatin (that was Exemplified Compound G-8 given in JP Application No. 1-180787/1989) was added thereto and the resulting mixture was washed and desalted in the same method as in Example 1 given in JP Application No. 1-180787/1989. After completing the desalting treatment, the pAg at 40° C. was 8.0. Further, when making a redispersion, the mixture of the following compounds [A], [B] and [C] was added as an fungicide agent.

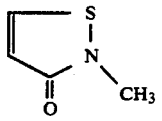

[A]

-continued

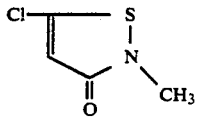

[B]

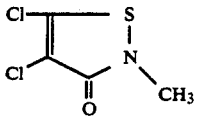

[C]

Preparation of Silver Halide Photographic Light Sensitive Material

On one of the 0.1 μm-thick layers undercoated on both sides of a 100 μm-thick polyethyleneterephthalate film (refer to Example 1 given in JP OPI Publication No. 59-19941/1984), a silver halide emulsion layer having the following chemical formula (1) was so coated as to have a gelatin content of 2.0 g/m² and a silver content of 3.2 g/m² and an emulsion protective layer having the following chemical formula (2) was then so coated thereon as to have a gelatin content of 1.0 g/m². Further, on another undercoated layer on the opposite side of the film, a backing layer having the following chemical formula (3) was so coated as to have a gelatin content of 2.4 g/m² and a backing protective layer having the following chemical formula (4) was so coated thereon as to have a gelatin content of 1.0 g/m², so that Samples No.1 through No.34 could be prepared.

| | |
|---|---|
| Chemical Formula (1) | |
| (Composition of the Silver Halide Emulsion) | |
| Gelatin | 2.0 g/m² |
| Silver halide emulsion A | 3.2 g/m² |
| (in terms of the silver content) | |
| Sensitizing dye: SD-1 | 8.0 mg/m² |
| Sensitizing dye: SD-2 | 0.2 mg/m² |
| Stabilizer: | 30 mg/m² |
| 4-methyl-6-hydroxy-1,3,3a,7-tetrazaindene | |
| Antifoggant: Adenine | 10 mg/m² |
| Surfactant: Saponin | 0.1 g/m² |
| Surfactant: S-1 | 8.0 mg/m² |
| Hydrazine derivative [I] | 30 mg/m² |
| relating to the invention | |
| Latex polymer: LX | 1.0 g/m² |
| Polyethylene glycol | 0.1 g/m² |
| (having a molecular weight of 4000) | |
| Layer hardener: H-1 | 60 mg/m² |
| Chemical Formula (2) | |
| (Composition of the Emulsion Protective Layer) | |
| Gelatin | 1.0 g/m² |
| Surfactant: S-2 | 10 mg/m² |
| Matting agent: Silica | 3 mg/m² |
| having an average particle size of 3.5 μm | |
| Layer hardener: Formalin | 30 mg/m² |
| Surfactant: S-3 | 10 mg/m² |
| Chemical Formula (3) | |
| (Composition of the Backing Layer) | |
| D-1 | 30 mg/m² |
| D-2 | 75 mg/m² |
| D-3 | 30 mg/m² |
| Gelatin | 2.4 g/m² |
| Surfactant: S-1 | 6.0 mg/m² |
| Surfactant: Saponin | 0.1 g/m² |
| Chemical Formula (4) | |
| (Composition of the Backing Protective Layer) | |
| Gelatin | 1 g/m² |
| Matting agent: Polymethyl methacrylate | 15 mg/m² |
| having an average particle size of 3.0~5.0 μm | |
| Surfactant: S-2 | 10 mg/m² |
| Layer hardener: Glyoxal | 25 mg/m² |

-continued

| | |
|---|---|
| Layer hardener: H-1 | 35 mg/m$^2$ |

The compounds used in Chemical Formulas (1), (2) and (3) will be given below.

SD-1

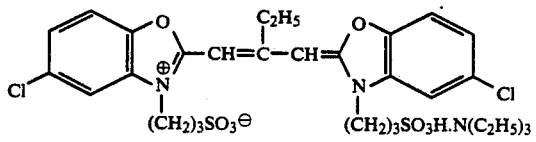

SD-2

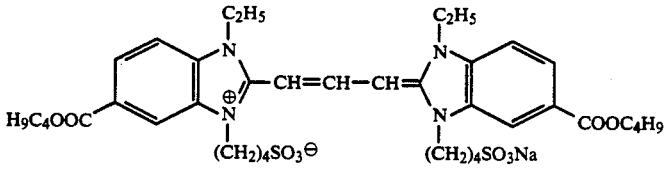

S-1

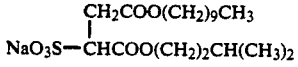

LX

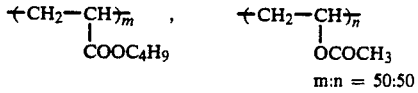

m:n = 50:50

H-1

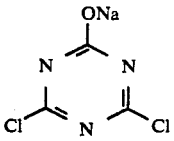

S-2

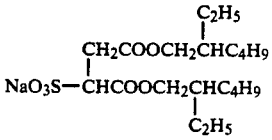

S-3

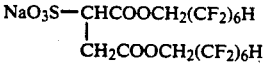

D-1

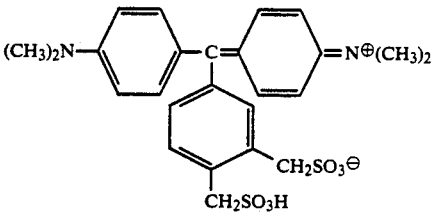

D-2

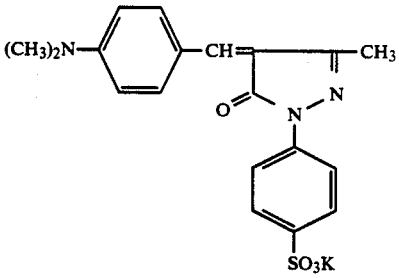

D-3

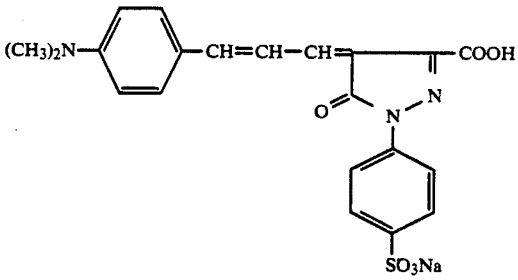

The resulting samples were each subjected to the halftone dot quality tests in the following procedures.

Halftone Dot Quality Test Procedures

A step-wedge was partially attached with a contact halftone screen (of 150 lines/inch) having a halftone dot area of 50%. A sample was brought into close contact with the resulting step-wedge and was then exposed to a Xenon light source for 5 seconds. The exposed sample was developed through an automatic processor for rapid processing upon putting, the following developer and fixer therein under the following conditions. The resulting halftone dot quality of the sample was observed through a 100× magnifier. The results of the observation were evaluated in terms of five ranks; [5] for the highest halftone dot quality and [4], [3], [2] and [19 in order for the lower qualities, respectively. Among these ranks, [1] and [2] were proved to be unpreferable to put to practical use.

The resulting fogginess in the halftone dots were also evaluated in the similar manner to the above and the samples having no black dot at all were evaluated to be the highest rank [5] and the ranks [4], [3], [2] and [1] according to the order of how many black dots were produced, respectively.

Among these ranks, [1] and [2] were proved to be unpreferable to put to practical use.

emulsion layers in Formula (1), the following compounds (a), (b) and (c) were each added.

(a)

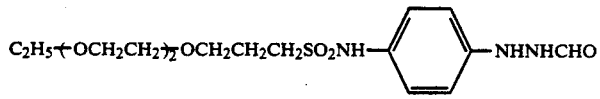

(b)

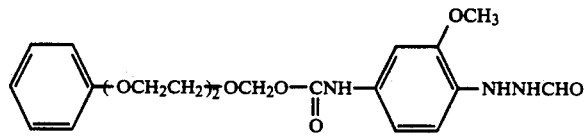

(c)

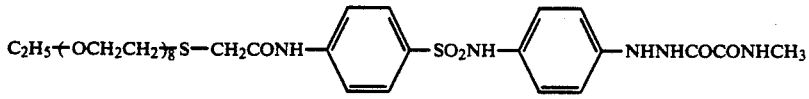

| Formula of Developer | |
|---|---|
| Hydroquinone | 45.0 g |
| N-methyl-P-aminophenol ½ sulfate | 0.8 g |
| Sodium hydroxide | 18.0 g |
| Potassium hydroxide | 55.0 g |
| 2-sulfosalicylic acid | 45.0 g |
| Boric acid | 25.0 g |
| Potassium sulfite | 110.0 g |
| Sodium ethylenediamine tetraacetate | 1.0 g |
| Potassium bromide | 6.0 g |
| a. | |
| Formula of Fixer | |
| (Composition A) | |
| Ammonium thiosulfate (in an aqueous 72.5 w/v % solution) | 240 ml |
| Sodium sulfite | 17 g |
| Sodium acetate.trihydrate | 6.5 g |
| Boric acid | 6 g |
| Sodium citrate.dihydrate | 2 g |
| (Composition B) | |
| Pure water (ion-exchange water) | 17 ml |
| Sulfuric acid (in an aqueous 50% w/w solution) | 4.7 g |
| Aluminium sulfate (an aqueous solution of 8.1 w/w % in terms of $Al_2O_3$ content) | 26.5 g |

When the fixer was used, the above-given Compositions A and B were dissolved in order in 500 ml of water so as to make 1 liter in total. The pH of the fixer was adjusted to be 4.8 with acetic acid.

(Conditions for Development Process)

| (Processing step) | (Temperature) | (Time) |
|---|---|---|
| Developing | 40° C. | 15 sec. |
| Fixing | 35° C. | 15 sec. |
| Washing | 30° C. | 10 sec. |
| Drying | 50° C. | 10 sec. |

As for the comparative compounds to the hydrazine compounds of the invention added into the silver halide The results of the quality tests will be given in the following Tables 1 and 2.

TABLE 1

| No. | Hydrazine | Dot quality | Black dot | Remarks |
|---|---|---|---|---|
| 1 | a | 3.5 | 3.5 | Comparison |
| 2 | b | 2 | 4 | Comparison |
| 3 | c | 3.5 | 3.5 | Comparison |
| 4 | I-1 | 4.5 | 4.5 | Invention |
| 5 | I-2 | 5 | 5 | Invention |
| 6 | I-4 | 4.5 | 4.5 | Invention |
| 7 | I-5 | 4 | 5 | Invention |
| 8 | I-6 | 5 | 4 | Invention |
| 9 | I-7 | 4.5 | 5 | Invention |
| 10 | I-9 | 4.5 | 4.5 | Invention |
| 11 | I-10 | 4.5 | 5 | Invention |
| 12 | I-14 | 4.5 | 4 | Invention |
| 13 | I-15 | 5 | 4.5 | Invention |
| 14 | I-16 | 4.5 | 4.5 | Invention |
| 15 | I-17 | 4 | 4.5 | Invention |
| 16 | I-18 | 5 | 5 | Invention |
| 17 | I-22 | 5 | 5 | Invention |
| 18 | I-30 | 5 | 4.5 | Invention |
| 19 | I-31 | 4 | 4.5 | Invention |
| 20 | I-36 | 4.5 | 5 | Invention |
| 21 | I-38 | 4 | 4 | Invention |
| 22 | I-42 | 4 | 4 | Invention |
| 23 | I-43 | 4 | 4 | Invention |
| 24 | I-44 | 3.5 | 4.5 | Invention |
| 25 | I-45 | 4.5 | 3.5 | Invention |
| 26 | I-47 | 4.5 | 3.5 | Invention |
| 27 | I-48 | 4.5 | 3.5 | Invention |
| 28 | I-50 | 4.5 | 3.5 | Invention |
| 29 | I-52 | 3.5 | 4.5 | Invention |
| 30 | I-53 | 3.5 | 5 | Invention |
| 31 | I-57 | 3.5 | 4.5 | Invention |
| 32 | I-58 | 3.5 | 4.5 | Invention |
| 33 | I-60 | 3.5 | 5 | Invention |
| 34 | I-67 | 5 | 5 | Invention |

Note: Developer 3 was used.

TABLE 2

| | | Halftone dot quality | | | | Black dot | | | | |
|---|---|---|---|---|---|---|---|---|---|---|
| No. | Hydrazine | Developer 1 | Developer 2 | Developer 3 | Developer 4 | Developer 1 | Developer 2 | Developer 3 | Developer 4 | Remarks |
| 1 | a | 3 | 4 | 3.5 | 2.5 | 2 | 2.5 | 3.5 | 4 | Comp. |
| 2 | b | 3.5 | 3.5 | 2 | 1 | 2 | 3 | 4 | 4 | Comp. |
| 3 | c | 2 | 4 | 3.5 | 3 | 2 | 2.5 | 3.5 | 3.5 | Comp. |
| 5 | I-2 | 4 | 5 | 5 | 4 | 3.5 | 4.5 | 5 | 5 | Inv. |
| 7 | I-5 | 4.5 | 4.5 | 4 | 3.5 | 4 | 4.5 | 5 | 5 | Inv. |
| 8 | I-6 | 3.5 | 4.5 | 5 | 4 | 3.5 | 4 | 4 | 4.5 | Inv. |
| 9 | I-7 | 4.5 | 5 | 4.5 | 3.5 | 4 | 4 | 5 | 5 | Inv. |
| 10 | I-9 | 4.5 | 5 | 4.5 | 4 | 4 | 4.5 | 4.5 | 5 | Inv. |
| 11 | I-10 | 4.5 | 4.5 | 4.5 | 4 | 4 | 5 | 5 | 5 | Inv. |
| 12 | I-14 | 4 | 5 | 4.5 | 4 | 3.5 | 4 | 4 | 4.5 | Inv. |
| 13 | I-15 | 4 | 5 | 5 | 4.5 | 3.5 | 4 | 4.5 | 5 | Inv. |

TABLE 2-continued

| No. | Hydrazine | Halftone dot quality Developer 1 | Developer 2 | Developer 3 | Developer 4 | Black dot Developer 1 | Developer 2 | Developer 3 | Developer 4 | Remarks |
|---|---|---|---|---|---|---|---|---|---|---|
| 14 | I-16 | 4.5 | 5 | 4.5 | 3.5 | 4 | 4.5 | 4.5 | 5 | Inv. |
| 16 | I-18 | 4 | 5 | 5 | 4.5 | 3.5 | 4 | 5 | 5 | Inv. |
| 20 | I-36 | 4 | 4.5 | 4.5 | 4 | 4 | 4 | 5 | 5 | Inv. |
| 21 | I-38 | 4 | 4.5 | 4 | 3.5 | 3 | 3.5 | 4 | 5 | Inv. |
| 22 | I-42 | 4 | 4 | 4 | 3 | 3.5 | 4 | 4 | 4.5 | Inv. |
| 23 | I-43 | 4 | 4.5 | 4 | 3.5 | 3 | 4 | 4 | 4.5 | Inv. |
| 34 | I-67 | 4 | 5 | 5 | 4.5 | 3.5 | 4.5 | 5 | 5 | Inv. |

Comp.: Comparison,
Inv.: Invention

It can be found from the contents of Table 1 that the samples relating to the invention resulted in the excellent comprehensive evaluations of the halftone dot qualities and black dot production as compared to the comparative samples. It can also be found from the contents of Table 2 that The stable halftone dot qualities and the more excellent black dot levels can be provided against the pH variations of the developers having the comparatively low pH ranges such as pH=10.5 to 11.2.

EXAMPLE 2

Preparation of Emulsion A

A monodisperse type silver bromide emulsion was prepared in the following manner.

While an aqueous solution containing ossein gelatin was being kept at 70° C. and violently stirred, both of an aqueous silver nitrate solution and an aqueous potassium bromide solution were added thereto at the same time in a controlled double-jet precipitation method, so that an octahedral emulsion having an average grain size of 0.4 μm could be obtained. To the resulting emulsion, 5 mg of sodium thiosulfate and 6 mg of chloroauric acid (tetrahydrate) were each added per mol of the silver content of the emulsion and the mixture thereof was chemically ripened by heating it at 75° C. for 80 minutes, so that a silver bromide core emulsion could be obtained. The core emulsion was grown up by further adding an aqueous silver nitrate solution and an aqueous solution containing potassium bromide and sodium chloride (in a mol rate of 50:50), so that an octahedral, monodisperse, core/shell type silver chlorobromide emulsion could be obtained. After washing and desalting the emulsion, 1.3 mg each of sodium thiosulfate and chloroauric acid (tetrahydrate) were added thereto per mol of the silver content of the emulsion and were then heated at 60° C. for 70 minutes. After making a chemical sensitization treatment, an internal latent image type silver halide emulsion could be prepared.

Preparation of Sample

On a paper support polyethylene-laminated on the both sides thereof, a color photographic light sensitive material having the following layer arrangement was prepared. The resulting sample is called Sample 35.

Sample 35 (in which the amounts of each compound are indicated by the amounts coated and the units are indicated by mg/dm$^2$, unless otherwise expressly stated; provided, the amounts of the emulsions are indicated by converting them into the corresponding silver contents and the structures of the compounds will be given layer)

| | |
|---|---|
| Layer 7 (a protective layer) | |
| Gelatin | 12.3 |
| Layer 6 (a UV absorption layer) | |
| Gelatin | 5.4 |
| UV absorbent (UV-1) | 1.0 |
| UV absorbent (UV-2) | 2.8 |
| Solvent (SO-3) | 1.2 |
| Layer 5 (a blue light sensitive layer) | |
| Emulsion A (containing sensitizing dye BD-1) | 5.0 |
| Gelatin | 13.5 |
| Yellow coupler (YC-1) | 8.4 |
| Image stabilizer (AO-3) | 3.0 |
| Solvent (SO-1) | 5.2 |
| Compound (d) | $5 \times 10^{-3}$ mols/mol of Ag |
| Layer 4 (a yellow filter layer) | |
| Gelatin | 4.2 |
| Yellow colloidal silver | 1.0 |
| UV absorbent (UV-1) | 0.5 |
| UV absorbent (UV-2) | 1.4 |
| Color-mixing inhibitor (AS-1) | 0.4 |
| Solvent (SO-3) | 0.8 |
| Layer 3 (a green light sensitive layer) | |
| Emulsion A (containing sensitizing dye GD-1) | 2.7 |
| Gelatin | 13.0 |
| Magenta coupler (MC-1) | 2.4 |
| Image stabilizer (AO-1) | 2.0 |
| Solvent (SO-4) | 3.15 |
| Compound (d) | $5 \times 10^{-3}$ mols/mol of Ag |
| Layer 2 (a color-mixing inhibition layer) | |
| Gelatin | 7.5 |
| Color-mixing inhibitor (AS-1) | 0.55 |
| Solvent (SO-2) | 0.72 |
| Layer 1 (a red light sensitive layer) | |
| Emulsion A (containing sensitizing dyes RD-1 and RD-2) | 4.0 |
| Gelatin | 13.8 |
| Cyan coupler (CC-1) | 2.1 |
| Cyan coupler (CC-2) | 2.1 |
| Image stabilizer (AO-3) | 2.2 |
| Solvent (SO-1) | 3.3 |
| Compound (d) | $5 \times 10^{-3}$ mols/mol of Ag |

In addition to the above, SA-1 and SA-2 were used as the coating aids and HA-2 was used as a layer hardener, so that the layers were coated.

The compounds used in the above-mentioned layers will be given below.

RD-1 RD-2

-continued
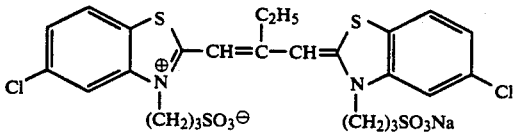
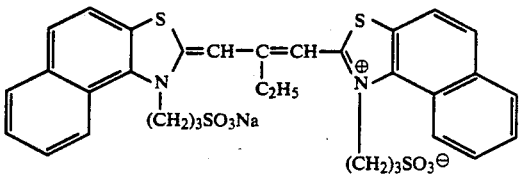
GD-1
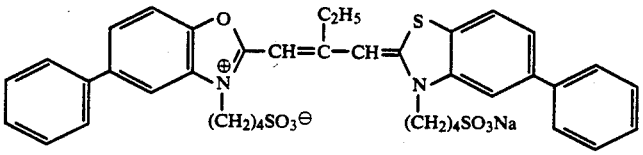
BD-1
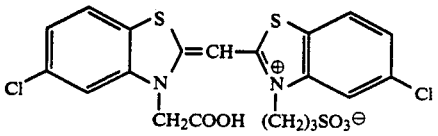
CC-1
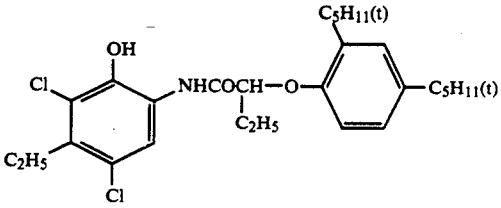
CC-2
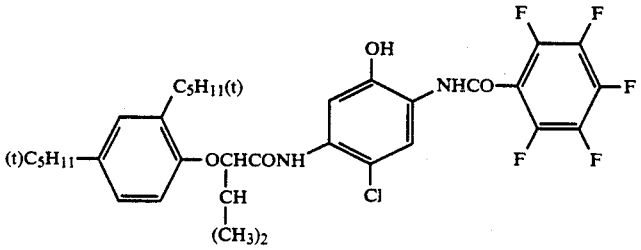
MC-1
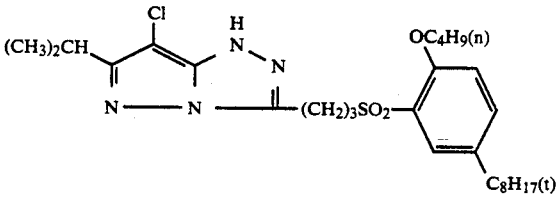
YC-1
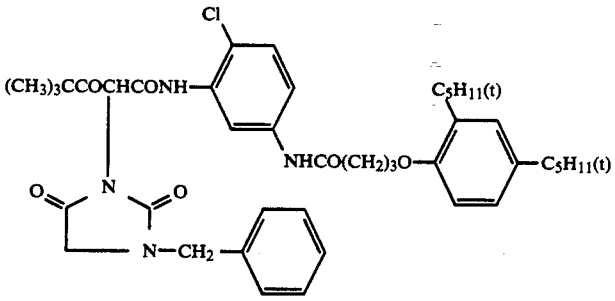
SO-1
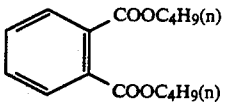
SO-2
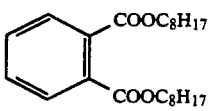
SO-3
SO-4

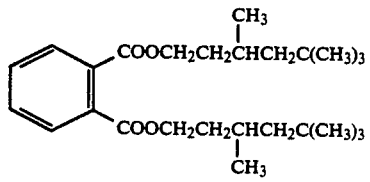

AS-1

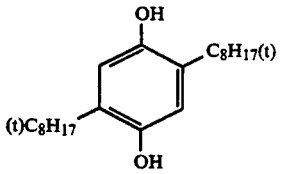

AO-3

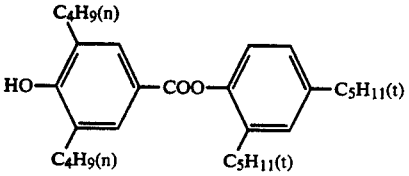

UV-1

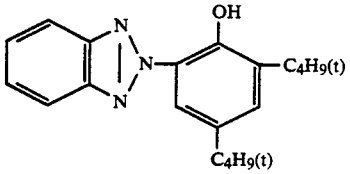

SA-1

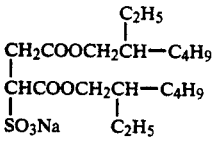

-continued

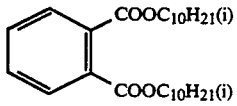

AO-1

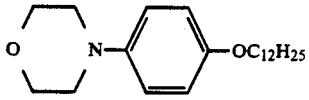

HA-2

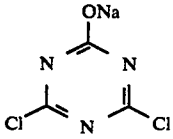

UV-2

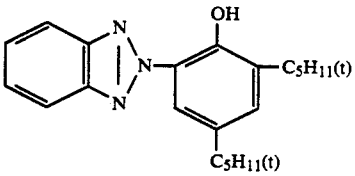

SA-2

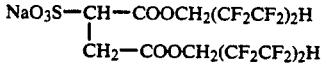

On the other hand, Samples 36~44 were each prepared in the same manner as in Sample 35, except that Compound (d) of each layer of Sample 35 were replaced by Compound (e) or the foggants of the invention represented by Formula [I] shown in Table 3, respectively.

The structures of the above-mentioned compounds (d) and (e), which were used therein as the comparative foggants, will be given below.

Each of the resulting samples was exposed to light through an optical wedge by making use of a photosensitometer and was then processed in the following processing steps.

(Process-1)

| Processing step | Processing time | Processing temperature |
|---|---|---|
| Color developing | 2 min. | 33° C. |
| Bleach-fixing | 40 sec. | 33° C. |

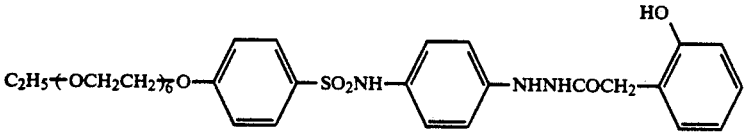

(d)

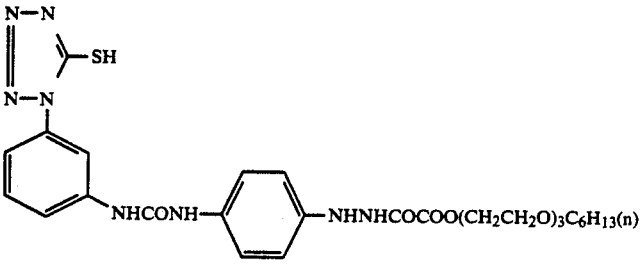

(e)

-continued

| | | |
|---|---|---|
| Stabilizing | 20 sec × 3 times | 33° C. |
| Drying | 30 sec. | 60~80° C. |
| <Color developer-1> | | |
| Diethylenetriamine pentaacetic acid | | 2.0 g |
| Benzyl alcohol | | 12.8 g |
| Diethylene glycol | | 3.4 g |
| Sodium sulfite | | 2.0 g |
| Sodium bromide | | 0.5 g |
| Hydroxylamine sulfuric acid | | 2.6 g |
| Sodium chloride | | 3.2 g |
| 3-methyl-4-amino-N-ethyl-N-(β-methanesulfonamidoethyl)aniline | | 4.25 g |
| Potassium carbonate | | 30.0 g |
| Fluorescent whitening agent (a 4,4'-diaminostilbene disulfonic acid derivative) | | 1.0 g |
| Add water to make | | 1 liter |
| Adjust pH (with potassium hydroxide and sulfuric acid) to be | | 10.5 |
| <Formula of Bleach-fixer> | | |
| Ammonium thiosulfate (at 54 wt %) | | 150 ml |
| Sodium sulfite | | 15 g |
| Iron ethylenediaminetetraacetate | | 55 g |
| Sodium ammonium (III) ethylenediamine tetraacetate (dihydrate) | | 4 g |
| Glacial acetic acid | | 8.61 g |
| Add water to make | | 1 liter |
| Adjust pH (with aqueous ammonia or hydrochloric acid) to be | | 5.4 |
| <Stabilizer> | | |
| 1-hydroxyethylidene-1,1'-diphosphoric acid (in a 60% solution)) | | 1.6 ml |
| Bismuth chloride | | 0.35 g |
| Polyvinyl pyrrolidone | | 0.25 g |
| Aqueous ammonia | | 2.5 ml |
| Trisodium nitrilotriacetate | | 1.0 g |
| 5-chloro-2-methyl-4-isothiazoline-3-one | | 50 mg |
| 2-octyl-4-isothiazoline-3-one | | 50 mg |
| Fluorescent whitening agent (of the 4,4'-diaminostilbene type) | | 1.0 g |
| Add water to make | | 1 liter |
| Adjust pH (with potassium hydroxide or hydrochloric acid) to be | | 7.5 |
| (Process-2) | | |

This process is the same as Process-1, except that the pH of the color developer was adjusted to be 11.0.

The resulting images were each subjected to sensitometry and the maximum density (Dmax) and the minimum density (Dmin) of the magenta images were evaluated. The results thereof are shown in Table 3 given below.

TABLE 3

| No. | Hydrazine | Magenta image | Process-1 | Process-2 | Remarks |
|---|---|---|---|---|---|
| 35 | d | Dmax | 1.69 | 2.01 | Comparison |
| | | Dmin | 0.16 | 0.21 | |
| 36 | e | Dmax | 1.53 | 1.96 | Comparison |
| | | Dmin | 0.15 | 0.19 | |
| 37 | I-1 | Dmax | 1.98 | 2.07 | Invention |
| | | Dmin | 0.12 | 0.16 | |
| 38 | I-2 | Dmax | 2.03 | 2.15 | Invention |
| | | Dmin | 0.13 | 0.17 | |
| 39 | I-4 | Dmax | 1.95 | 2.10 | Invention |
| | | Dmin | 0.12 | 0.15 | |
| 40 | I-6 | Dmax | 2.02 | 2.17 | Invention |
| | | Dmin | 0.13 | 0.17 | |
| 41 | I-16 | Dmax | 1.96 | 2.09 | Invention |
| | | Dmin | 0.12 | 0.15 | |
| 42 | I-17 | Dmax | 1.90 | 2.10 | Invention |
| | | Dmin | 0.13 | 0.17 | |
| 43 | I-18 | Dmax | 2.01 | 2.14 | Invention |
| | | Dmin | 0.14 | 0.16 | |
| 44 | I-67 | Dmax | 2.04 | 2.17 | Invention |
| | | Dmin | 0.13 | 0.18 | |

As is obvious from Table 3, it was proved that the samples (Samples 37 through 44) each containing the foggants of the invention can provide excellent positive images having a higher maximum density and a lower minimum density even when they are treated in a low pH process, as compared to the samples (Samples 35 and 36) each containing the comparative compounds which are well-known foggants.

EXAMPLE 3

Samples 45 through 54 were each prepared in quite the same manner as in Example 2, except that the foggants used in Example 2 were replaced by the compounds shown in Table 4.

The resulting samples were exposed to light in the same manner as in Example 3 and were then processed in Process-1. The minimum density of each of the resulting magenta images was named Dmin.

On the other hand, a fresh sample (that was unexposed and undeveloped) was preserved for 3 days under the conditions of 50° C. and 80%RH so as to be thermostatically aged and, after that, it was exposed to light and processed in the same manner as mentioned before. The minimum density of the resulting magenta image was named (Dmin)'.

Dmin and (Dmin)' values are shown in Table 4 given below.

TABLE 4

| No. | Hydrazine | Dmin | (Dmin)' | Remarks |
|---|---|---|---|---|
| 45 | d | 0.16 | 0.31 | Comparison |
| 46 | e | 0.15 | 0.27 | Comparison |
| 47 | I-2 | 0.13 | 0.20 | Invention |
| 48 | I-6 | 0.13 | 0.22 | Invention |
| 49 | I-9 | 0.12 | 0.19 | Invention |
| 50 | I-10 | 0.13 | 0.21 | Invention |
| 51 | I-14 | 0.14 | 0.23 | Invention |
| 52 | I-16 | 0.12 | 0.20 | Invention |
| 53 | I-18 | 0.14 | 0.24 | Invention |
| 54 | I-36 | 0.12 | 0.21 | Invention |

As is obvious from Table 4, it is proved that the samples (Samples 47 through 54) containing the foggants of the invention were few in the minimum density increase and excellent in the aging stability of any fresh samples even after an aging preservation, as compared to the samples (Samples 45 and 46) containing the comparative compound that is well known foggant.

What is claimed is:

1. A silver halide photographic light-sensitive material comprising a support having thereon a silver halide emulsion layer, wherein said silver halide photographic material contains a compound represented by the following formula [I],

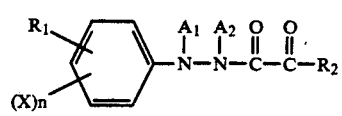

formula [I]

wherein $R_1$ represents $R_3O$— in which $R_3$ represents a hydrogen atom, an aliphatic group, an aromatic group or a heterocyclic group; $R_4$—$SO_2NH$— in which $R_4$ represents an aliphatic group, an aromatic group or a heterocyclic group; $(R_5)$ $(R_6)PO$—NH— in which $R_5$ and $R_6$ represent each an aliphatic group, an aromatic group, a heterocyclic group, —$OR_0$ or —$N(R_0)$ $(R_{00})$ wherein $R_0$ represents an aliphatic group, an aromatic group or a heterocyclic group and $R_{00}$ represents a hydrogen atom, an aliphatic group, an aromatic group or a heterocyclic group; N≡C—NH—; HS—; HO—N=CH—; $(R_7)$ $(R_8)$N— in which $R_7$ and $R_8$ represent each a hydrogen atom, an aliphatic group, an aromatic group or a heterocyclic group; $(R_8)$ $(R_{10})$C=N— in which $R_8$ represents a hydrogen atom, an aliphatic group, an aromatic group or a heterocyclic group and $R_{10}$ represents an aliphatic group, an aromatic group or a heterocyclic group, an active methylene group or an active methine group; X represents a substituent; n represents an integer of 0 to 4, provided that when n is not less than 2, X may be the same as or different from each other; $A_1$ and $A_2$ represent each a hydrogen atom or one of them represents a hydrogen atom and the other one represents an acyl group, a sulfonyl group or an oxalyl group; $R_2$ represents a group represented by the following formula [II] or [III], $$-OR_{11} \qquad \text{formula [II]}$$

$$-N(R_{12})(R_{13}) \qquad \text{formula [III]}$$

wherein $R_{11}$ represents an alkenyl group, an alkynyl group, an aryl group or a heterocyclic group; $R_{12}$ represents a hydrogen atom, an aliphatic group, an aromatic group or a heterocyclic group; and $R_{13}$ represents an alkenyl group, an alkynyl group, an aryl group, a hydroxy group, an alkoxy group or a heterocyclic group; provided that in formula [I], at east one of $R_1X$ or $R_2$ represents a group having the component structure represented by the following formula [IV], $$-(O-Y)_m- \qquad \text{formula [IV]}$$

wherein Y represents an alkylene group, an alkenylene group or an arylene group, each of which may have a substituent; and m is an integer of not less than 2.

2. The silver halide photographic material of claim 1, wherein in formula [I], $R_1$ represents $R_3O$—, $R_4$—$SO_2NH$— or N≡C—NH— as defined in claim 1.

3. The silver halide photographic material of claim 1, wherein $A_1$ and $A_2$ represent each a hydrogen atom.

4. The silver halide photographic material of claim 1, wherein in formula [II], $R_{11}$ represents an alkynyl group or a saturated heterocyclic ring group.

5. The silver halide photographic material of claim 1, wherein in formula [III], $R_{12}$ represents a hydrogen atom, an aliphatic group or an aromatic group, and $R_{13}$ represents an alkenyl group, an alkynyl group or a saturated heterocyclic ring group.

6. The silver halide photographic material of claim 1, wherein in formula [IV], Y represents an alkylene group.

7. The silver halide photographic material of claim 1, wherein said compound represented by formula [I] is contained in an amount of $5\times10^{-7}$ to $5\times10^{-1}$ mol per mol of silver halide.

8. The silver halide photographic material of claim 1, wherein said silver halide emulsion layer contains silver halide grains comprising silver iodochlorobromide or silver iodobromide.

* * * * *

UNITED STATES PATENT AND TRADEMARK OFFICE

CERTIFICATE OF CORRECTION

PATENT NO. : 5,279,920

DATED :January 18, 1994

INVENTOR(S) : Akira Onodera, et al.

It is certified that error appears in the above-indentified patent and that said Letters Patent is hereby corrected as shown below:

Claim 1, column 51, line 4 change "($R_8$)" to --($R_9$)--.

column 51, line 5 change "($R_8$)" to --($R_9$)--.

column 51, line 29 change "east" to --least-- and "$R_1X$" to $R_1$,X--.

Signed and Sealed this

Twenty-seventh Day of September, 1994

*Attest:*

Bruce Lehman

BRUCE LEHMAN

*Attesting Officer*

*Commissioner of Patents and Trademarks*